US010383388B2

(12) United States Patent
Podhajny

(10) Patent No.: US 10,383,388 B2
(45) Date of Patent: Aug. 20, 2019

(54) ARTICLE OF FOOTWARE WITH UPPER INCORPORATING KNITTED COMPONENT PROVIDING VARIABLE COMPRESSION

(71) Applicant: NIKE, Inc., Beaverton, OR (US)

(72) Inventor: Daniel A. Podhajny, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 276 days.

(21) Appl. No.: 14/200,521

(22) Filed: Mar. 7, 2014

(65) Prior Publication Data

US 2015/0250256 A1 Sep. 10, 2015

(51) Int. Cl.

| | |
|---|---|
| ***A43B 1/02*** | (2006.01) |
| ***A43B 5/00*** | (2006.01) |
| ***A43B 1/04*** | (2006.01) |
| ***A43B 23/04*** | (2006.01) |

(Continued)

(52) U.S. Cl.

CPC ..... *A43B 1/02* (2013.01); *A43B 1/04* (2013.01); *A43B 5/00* (2013.01); *A43B 23/042* (2013.01); *A43C 11/1493* (2013.01); *D04B 1/02* (2013.01); *D10B 2403/032* (2013.01); *D10B 2501/043* (2013.01); *D10B 2501/0632* (2013.01)

(58) Field of Classification Search

CPC ..... A43B 1/02; A43B 5/00; A43B 23/042; A43C 11/1493; D04B 1/02; D10B 2501/043; D10B 2501/0632

USPC ..... 36/83, 88, 93, 50.1, 51; 66/169 R, 170, 66/171

See application file for complete search history.

(56) References Cited

U.S. PATENT DOCUMENTS

| | | | |
|---|---|---|---|
| 401,007 | A | 4/1889 | Caspary |
| 1,542,848 | A | 6/1925 | Barnes |

(Continued)

FOREIGN PATENT DOCUMENTS

| | | | |
|---|---|---|---|
| CN | 2448147 | Y | 9/2001 |
| CN | 1861866 | A | 11/2006 |

(Continued)

OTHER PUBLICATIONS

International Search Report and Written Opinion for Application No. PCT/US2015/010232, dated Jun. 29, 2015.

(Continued)

*Primary Examiner* — Shaun R Hurley
*Assistant Examiner* — Bao-Thieu L Nguyen
(74) *Attorney, Agent, or Firm* — Brinks Gilson & Lione

(57) ABSTRACT

An article of footwear includes a sole structure and an upper that is attached to the sole structure. The upper includes a knitted component with a compression member that is configured to apply compression to the wearer. The knitted component also includes a selection element that is configured for selecting and changing the amount of compression applied by the compression member. The selection element is spaced away from the sole structure. The selection element includes a first area and a second area. The first area is configured to move relative to the second area between an unsecured position and a secured position to change the amount of compression applied by the compression member. The first area is spaced away from the second area in the unsecured position, and the first area is attached to the second area in the secured position.

15 Claims, 22 Drawing Sheets

(51) Int. Cl.
*A43C 11/14* (2006.01)
*D04B 1/02* (2006.01)

(56) References Cited

U.S. PATENT DOCUMENTS 1,910,251 A * 5/1933 Joha ..... D04B 1/24 66/177
1,960,165 A 5/1934 Ottinger
D101,046 S * 9/1936 Kean ..... 36/50.1
2,147,197 A * 2/1939 Glidden ..... A43B 1/02 36/3 A
2,552,064 A 5/1951 Rollmann
2,675,631 A * 4/1954 Doughty ..... A43B 1/04 36/12
2,919,503 A * 1/1960 Sholovitz ..... A43D 113/00 36/16
3,106,790 A * 10/1963 Zimmon ..... A43B 3/101 2/919
3,110,117 A * 11/1963 Ruebel ..... A43B 3/30 36/112
3,327,410 A * 6/1967 Park, Sr. ..... A43B 5/00 24/442
3,377,721 A * 4/1968 Johnson ..... A43B 5/0405 12/142 R
3,613,273 A * 10/1971 Marquis ..... A43B 5/00 36/113
3,786,580 A * 1/1974 Dalebout ..... A43B 5/0405 12/142 P
4,065,861 A * 1/1978 Pelfrey ..... A43B 5/02 36/133
4,079,527 A * 3/1978 Antonious ..... A43C 11/008 36/50.1
4,114,297 A * 9/1978 Famolare, Jr. ..... A43C 11/008 24/306
4,270,285 A * 6/1981 Antonious ..... A43B 3/08 24/306
4,282,657 A * 8/1981 Antonious ..... A43B 5/00 24/306
4,296,558 A * 10/1981 Antonious ..... A43C 11/008 36/102
4,308,672 A * 1/1982 Antonious ..... A43C 11/1493 24/306
4,366,634 A * 1/1983 Giese ..... A43B 5/00 36/114
4,370,818 A * 2/1983 Simoglou ..... A43B 3/24 36/100
4,377,913 A * 3/1983 Stone ..... A43C 11/1493 36/50.1
4,411,077 A * 10/1983 Slavitt ..... A43B 5/00 36/114
4,441,265 A * 4/1984 Burns ..... A43B 7/20 36/114
4,451,995 A * 6/1984 Antonious ..... A43B 23/047 36/51
4,463,761 A * 8/1984 Pols ..... A43B 7/00 36/140
4,512,089 A 4/1985 Carrier
4,547,982 A * 10/1985 Gamm ..... A43B 3/0031 36/114
4,628,622 A * 12/1986 McBarron ..... A43B 11/00 36/112
4,704,810 A * 11/1987 Massengale ..... A43B 5/18 36/130
RE32,585 E * 2/1988 Antonious ..... A43C 11/1493 24/306
4,845,864 A * 7/1989 Corliss ..... A43B 5/14 36/131
4,969,277 A 11/1990 Williams
4,989,350 A * 2/1991 Bunch ..... A43B 5/00 36/114
5,269,078 A * 12/1993 Cochrane ..... A43B 5/00 36/170
5,323,549 A * 6/1994 Segel ..... A43B 7/1495 36/140
5,337,493 A * 8/1994 Hill ..... A43B 23/26 36/114
5,345,638 A * 9/1994 Nishida ..... A41H 3/08 12/146 C
5,353,483 A * 10/1994 Louviere ..... A43B 11/00 24/71 SK
5,379,529 A * 1/1995 Smith ..... A43B 5/00 36/50.1
5,408,761 A * 4/1995 Gazzano ..... A43B 5/00 36/102
5,503,892 A * 4/1996 Callaway ..... D04B 21/04 15/209.1
5,647,149 A * 7/1997 Dalebout ..... A43B 5/0405 36/10
5,673,448 A * 10/1997 Lang ..... A43B 5/0405 12/142 P
5,765,296 A * 6/1998 Ludemann ..... A43B 23/047 36/50.1
5,771,608 A * 6/1998 Peterson ..... A43B 5/00 36/50.1
5,819,439 A * 10/1998 Sanchez ..... A43B 5/00 36/89
5,970,629 A * 10/1999 Tucker ..... A43B 23/07 36/50.1
6,401,364 B1 * 6/2002 Burt ..... A43B 1/00 36/3 A
6,405,459 B1 * 6/2002 Prevost ..... A43B 1/0081 36/100
6,860,035 B2 * 3/2005 Girard ..... A43C 1/00 36/117.6
7,334,354 B2 * 2/2008 Foxen ..... A43B 3/24 36/100
7,380,354 B2 6/2008 Yamashita et al.
7,392,603 B1 * 7/2008 Shepherd ..... A43B 23/26 36/114
7,475,501 B1 1/2009 DeToro et al.
7,487,603 B2 * 2/2009 Davis ..... A43B 1/0081 36/50.1
7,650,705 B2 * 1/2010 Donnadieu ..... A43B 5/0411 36/45
7,765,721 B2 * 8/2010 Hentz, III ..... A43C 11/004 24/712.1
7,774,956 B2 8/2010 Dua
7,891,116 B1 * 2/2011 Iglikov ..... A43B 23/0205 36/4
8,006,410 B2 * 8/2011 Romboli ..... A43C 11/1493 36/50.1
8,156,665 B2 * 4/2012 Shepherd ..... A43B 1/0081 36/114
8,230,617 B2 * 7/2012 Luedecke ..... A43B 5/08 36/8.1
8,448,474 B1 * 5/2013 Tatler ..... A43B 23/0245 66/64
8,677,653 B2 * 3/2014 Avar ..... A43B 3/242 36/100
8,839,532 B2 * 9/2014 Huffa ..... A43B 1/04 36/45
8,959,959 B1 * 2/2015 Podhajny ..... A43B 1/04 66/177
8,973,410 B1 * 3/2015 Podhajny ..... A43B 23/024 66/177
8,997,529 B1 * 4/2015 Podhajny ..... D04B 1/16 36/47
8,997,530 B1 * 4/2015 Podhajny ..... A43B 1/04 66/177
9,066,560 B2 * 6/2015 Rodriguez ..... A43B 1/0081
9,247,781 B2 * 2/2016 Nishiwaki ..... A43B 7/1495
2002/0148142 A1 * 10/2002 Oorei ..... A43B 5/00 36/129
2003/0089000 A1 * 5/2003 Tseng ..... A43B 1/00 36/45
2003/0200679 A1 * 10/2003 Wilson ..... A43B 7/125 36/55

(56) References Cited

U.S. PATENT DOCUMENTS

2004/0003516 A1* 1/2004 Jacobs ..... A43C 11/008 36/50.1
2004/0045196 A1* 3/2004 Shepherd ..... A43B 5/00 36/114
2004/0118019 A1* 6/2004 Ito ..... A43B 1/0027 36/50.1
2004/0226076 A1* 11/2004 Chen ..... A41B 11/007 2/239
2005/0115111 A1* 6/2005 Yamashita ..... A43B 5/00 36/89
2005/0235525 A1* 10/2005 Jacobs ..... A43B 3/24 36/50.1
2006/0005432 A1* 1/2006 Kassai ..... A43B 7/20 36/138
2006/0236726 A1 10/2006 Hagens et al.
2007/0137069 A1* 6/2007 Patakos ..... A43B 1/0027 36/113
2007/0261269 A1* 11/2007 Petrie ..... A43C 11/008 36/50.1
2007/0277398 A1* 12/2007 Davis ..... A43B 1/0081 36/50.1
2008/0072629 A1 3/2008 Gehring
2008/0110048 A1* 5/2008 Dua ..... A43B 1/04 36/45
2008/0110049 A1* 5/2008 Sokolowski ..... A43B 3/0031 36/50.1
2008/0263897 A1* 10/2008 Shepherd ..... A43B 1/0081 36/89
2009/0019736 A1* 1/2009 Ng ..... A43B 3/06 36/25 R
2009/0031585 A1* 2/2009 Shepherd ..... A43B 1/0081 36/89
2009/0083998 A1* 4/2009 Luedecke ..... A43B 5/08 36/89
2009/0293318 A1* 12/2009 Garneau ..... A43B 5/14 36/131
2009/0300947 A1* 12/2009 Babolat ..... A43B 7/20 36/114
2010/0050477 A1* 3/2010 Zeek ..... A43B 5/00 36/132
2010/0154256 A1* 6/2010 Dua ..... A43B 1/04 36/25 R
2011/0113648 A1* 5/2011 Leick ..... A43B 1/0081 36/50.1
2011/0226821 A1* 9/2011 McGuire ..... A43B 1/0081 223/118
2011/0247238 A1* 10/2011 Chestnut ..... A43B 3/06 36/105
2011/0258876 A1* 10/2011 Baker ..... A43C 11/008 36/50.1
2011/0308110 A1* 12/2011 Berns ..... A43B 3/0063 36/89
2012/0079741 A1* 4/2012 Kohatsu ..... A43B 3/26 36/50.1
2012/0079746 A1* 4/2012 Ferreira ..... A43B 11/00 36/105
2012/0174433 A1* 7/2012 Mahoney ..... A43B 7/1425 36/28
2012/0204445 A1* 8/2012 Karandonis ..... A43B 3/06 36/83
2012/0233884 A1 9/2012 Greene
2012/0246973 A1* 10/2012 Dua ..... A43B 23/0235 36/83
2012/0255201 A1* 10/2012 Little ..... A43B 1/04 36/84
2013/0000150 A1* 1/2013 Hurd ..... A43B 7/20 36/89
2013/0008053 A1* 1/2013 Nishiwaki ..... A43B 23/0255 36/102
2013/0055590 A1* 3/2013 Mokos ..... A43B 1/04 36/45
2013/0118031 A1* 5/2013 Chenciner ..... A43C 1/06 36/88
2013/0192091 A1* 8/2013 Kohatsu ..... A43B 23/026 36/103
2013/0239438 A1 9/2013 Dua et al.
2013/0247415 A1* 9/2013 Kohatsu ..... A43B 3/0031 36/88
2013/0269209 A1* 10/2013 Lang ..... A43B 23/0205 36/45
2013/0305465 A1* 11/2013 Siegismund ..... A43B 9/12 12/146 C
2013/0305566 A1* 11/2013 Loverin ..... A43B 3/30 36/102
2014/0082962 A1* 3/2014 Rodriguez ..... A43B 1/0081 36/54
2014/0082964 A1* 3/2014 Lin ..... A43B 1/04 36/84
2014/0137433 A1* 5/2014 Craig ..... A43B 1/04 36/50.1
2014/0137434 A1* 5/2014 Craig ..... A43B 1/04 36/54
2014/0150292 A1* 6/2014 Podhajny ..... A43B 23/0205 36/50.1
2014/0157624 A1* 6/2014 Girard ..... A43B 3/06 36/50.1
2014/0237861 A1* 8/2014 Podhajny ..... D04B 1/123 36/9 R
2014/0238081 A1* 8/2014 Meir ..... D04B 1/22 66/64
2014/0245634 A1* 9/2014 Podhajny ..... A43B 23/0245 36/54
2014/0310983 A1* 10/2014 Tamm ..... A43B 23/0245 36/83
2014/0310984 A1* 10/2014 Tamm ..... D04B 1/102 36/84
2014/0377488 A1* 12/2014 Jamison ..... A43B 1/04 428/36.1
2015/0068061 A1* 3/2015 Farris ..... A43B 13/38 36/83
2015/0075031 A1* 3/2015 Podhajny ..... A43B 1/04 36/45
2015/0128449 A1* 5/2015 Lin ..... D04B 1/22 36/84
2015/0223552 A1* 8/2015 Love ..... A43C 15/02 36/134
2015/0257475 A1* 9/2015 Langvin ..... A43B 5/00 36/84
2015/0282565 A1* 10/2015 Kilgore ..... A43B 23/227 36/45
2015/0289592 A1* 10/2015 Song ..... A43B 1/0072 36/83
2015/0320139 A1* 11/2015 Peitzker ..... A43B 1/08 36/11.5
2015/0359290 A1* 12/2015 Podhajny ..... A43B 1/04 36/9 R
2016/0066651 A1* 3/2016 Terai ..... D04B 1/24 36/45
2016/0090670 A1* 3/2016 Meir ..... A43B 1/04 12/142 G

FOREIGN PATENT DOCUMENTS

CN 101500449 A 8/2009
CN 101562999 A 10/2009
CN 201328431 Y 10/2009
CN 201491796 U 6/2010
CN 201571566 U 9/2010
CN 102076237 A 5/2011
CN 202179177 U 4/2012
CN 202750821 U 2/2013
CN 202760295 U 3/2013
CN 103005771 A 4/2013
CN 203302455 U 11/2013
GB 477556 A 1/1938
WO WO 2013/005125 A1 1/2013

(56) References Cited

FOREIGN PATENT DOCUMENTS

OTHER PUBLICATIONS

Letter from Bruce Huffa dated Dec. 23, 2013 (71 Pages).
International Search Report and Written Opinion for corresponding PCT/US2015/010232, dated Jun. 29, 2015, 14 pages.
Office Action and relevant portion translation for corresponding Chinese Application No. 201510101316.4 dated Jun. 12, 2016, 8 pages.
Office Action and English translation for ROC (Taiwan) Application No. 104102756, dated Jun. 16, 2017, 9 pages.
Office Action and English Translation of Relevant Portions for Chinese Application No. 2015101013164, dated Sep. 13, 2017, 40 pages.
Office Action and English translation for corresponding ROC (Taiwan) Application No. 104102756, dated Dec. 7, 2016, 34 pages.
Office Action and English translation of relevant portion for Chinese Application No. 2015101013164, dated Mar. 2, 2017, 11 pages.
Office Action and English translation for ROC (Taiwan) Patent Application No. 104102756, dated Apr. 9, 2018, 6 pages.
Office Action for Sri Lanka Application No. 18972, dated Nov. 27, 2017, 1 page.
Examination Report for EP Application No. 15704398.5, dated Oct. 31, 2017, 6 pages.

* cited by examiner

ARTICLE OF FOOTWARE WITH UPPER INCORPORATING KNITTED COMPONENT PROVIDING VARIABLE COMPRESSION

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground.

In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber.

The upper generally extends over the instep and toe areas of the foot, along the medial and lateral sides of the foot and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements are conventionally utilized in manufacturing the upper. In athletic footwear, for example, the upper may have multiple layers that each includes a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

This section provides a general summary of the disclosure, and is not a comprehensive disclosure of its full scope or all of its features.

An article of footwear is disclosed that includes a sole structure and an upper that is attached to the sole structure. The upper defines a void that is configured to receive a foot of a wearer. The upper includes a knitted component formed of unitary knit construction. The knitted component includes a compression member that is configured to apply an amount of compression to the wearer to secure the article of footwear to the wearer's foot. The knitted component also includes a selection element that is configured for selecting and changing the amount of compression applied by the compression member. The selection element is spaced away from the sole structure. The selection element includes a first area and a second area. The first area is configured to move relative to the second area between an unsecured position and a secured position to change the amount of compression applied by the compression member. The first area is spaced away from the second area in the unsecured position, and the first area attached to the second area in the secured position.

Also an article of footwear is disclosed for supporting a wearer. The article of footwear includes a sole structure and an upper that includes a knitted component formed of unitary knit construction. The knitted component includes a collar and an adjacent region that is proximate collar. The collar has a rim that at least partially defines a collar opening. The collar has a greater elasticity than the adjacent region. The knitted component also has a selection element with a first area and a second area. The first area is configured to move relative to the second area between an unsecured position and a secured position. The first area is spaced away from the second area in the unsecured position. The first area is attached to the second area in the secured position. The selection element is configured to stretch the collar between a first position and a stretched position when moving between the unsecured position and the secured position. The collar is configured to compress against the wearer in the stretched position at a greater amount as compared to the first position.

Moreover, a method of manufacturing an upper for an article of footwear is disclosed. The upper includes a knitted component formed of unitary knit construction. The method includes manipulating a first strand to at least partially form a first area of the knitted component. The method also includes breaking the first strand to form a hook in the first area. Additionally, the method includes manipulating a second strand to at least partially form a second area of the knitted component. The first area is configured to move relative to the second area between an unsecured position and a secured position. The hook is spaced away from the second area in the unsecured position. The hook is secured to the second area in the secured position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The following discussion and accompanying figures disclose various features of an article of footwear. As will be discussed, the article of footwear can be worn on a foot and can extend about an ankle and/or lower leg of a wearer. The article of footwear can compress against the wearer's body to secure the footwear to the wearer. Also, as will be discussed, the footwear can include portions, areas, members, or parts that can be used to selectively vary the compression of the footwear on the wearer's foot, ankle, lower leg, and/or other body part. As such, the footwear can be securely attached to the wearer. The wearer can also select and adjust the tightness of the footwear, for example, depending on the wearer's activity. Also, the footwear can be adjusted for ensuring comfortable fit of the footwear.

Article of Footwear Configurations

Figure 1:
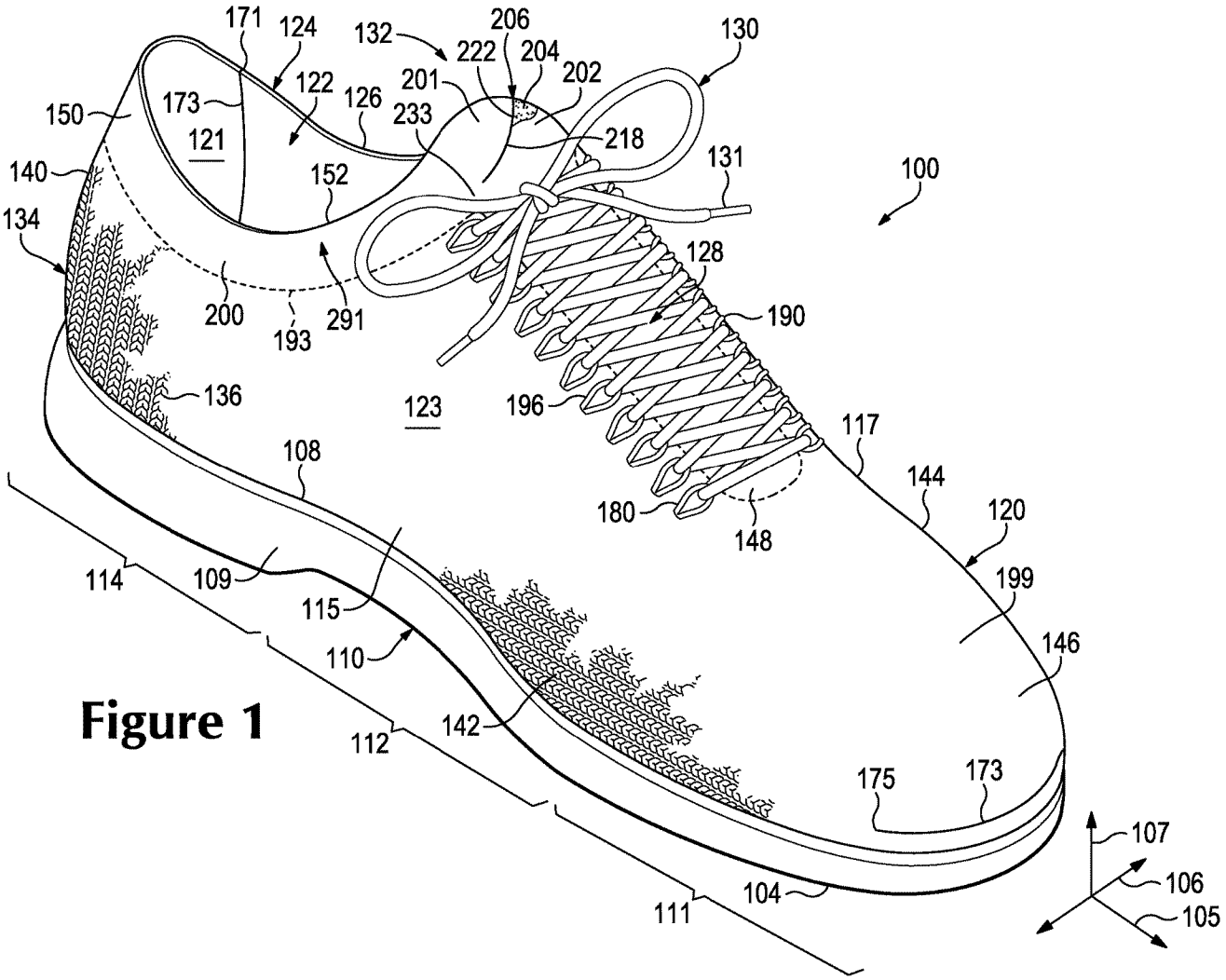
FIG. 1 is a perspective view of an article of footwear with a selection element according to the exemplary embodiments of the present disclosure.
Figure 2:
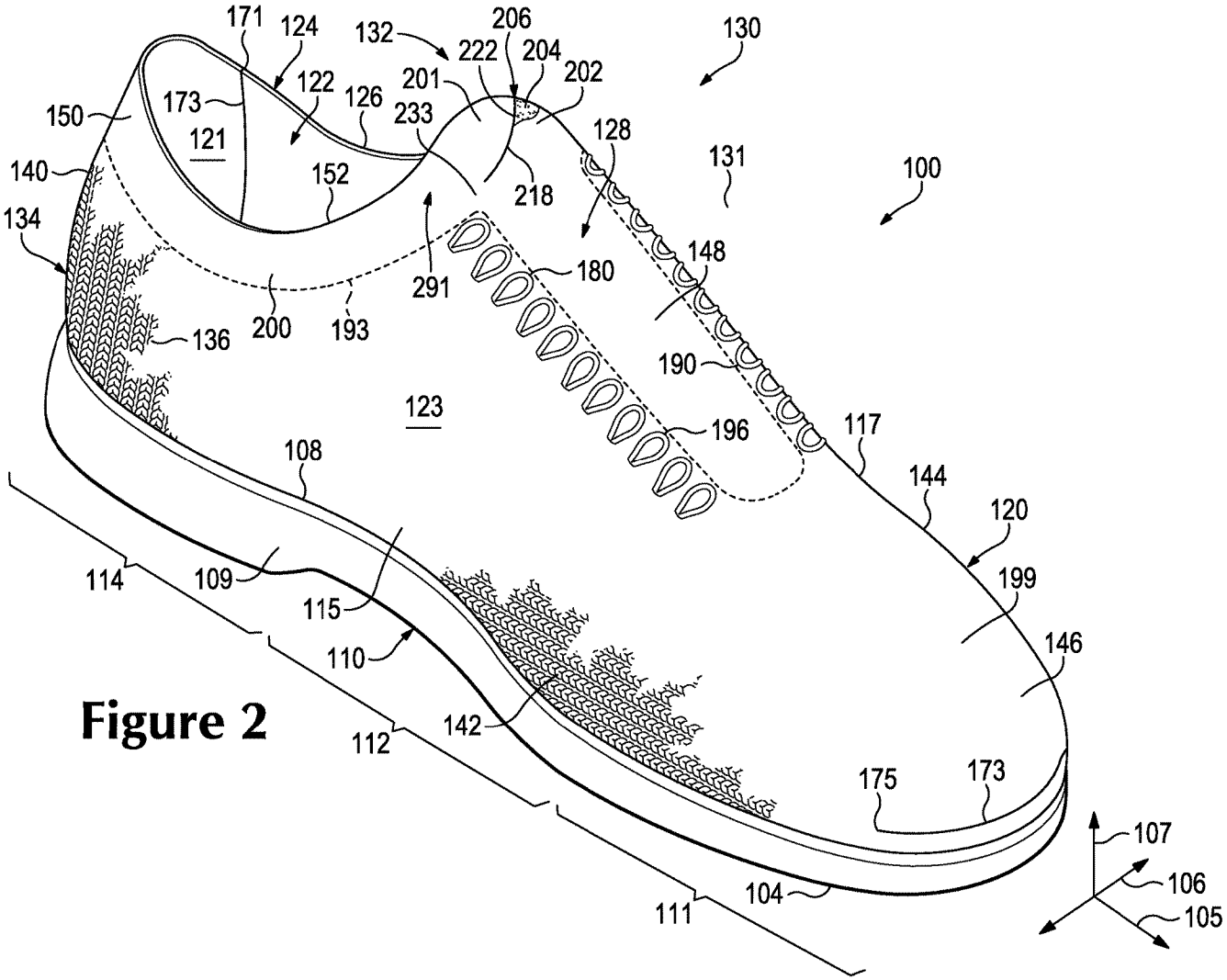
FIG. 2 is a perspective view of an upper and a sole structure of the article of footwear of FIG. 1.
Figure 3:
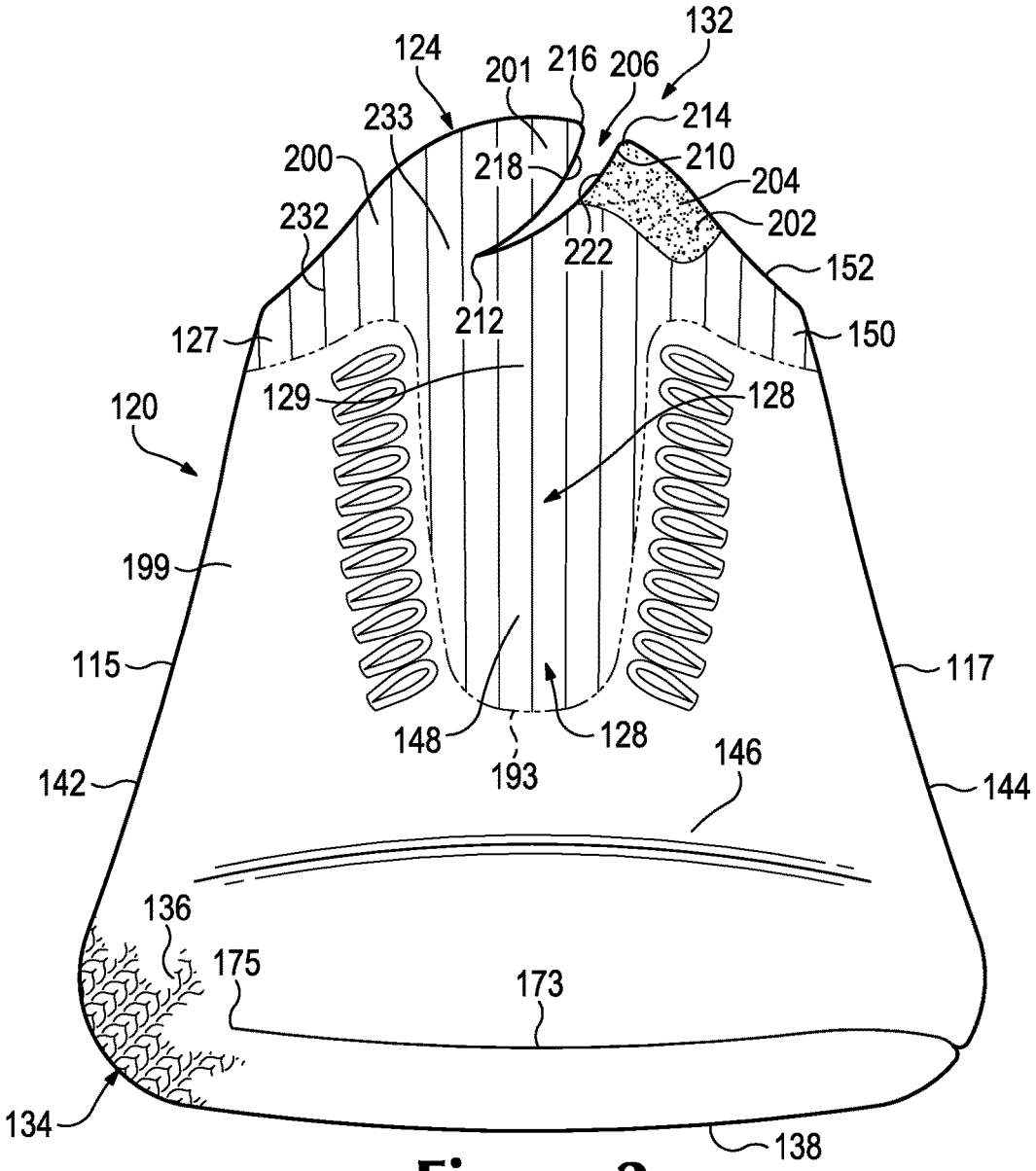
FIG. 3 is a front view of the upper of FIG. 1, wherein the selection element shown in a neutral or unsecured position.

Referring initially to FIGS. 1-3, an article of footwear 100 is illustrated according to exemplary embodiments. Generally, footwear 100 can include a sole structure 110 and an upper 120. Upper 120 can receive the wearer's foot and secure footwear 100 to the wearer's foot whereas sole structure 110 can extend underneath upper 120 and support wearer.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone. Footwear 100 can also include a lateral side 115 and a medial side 117. Lateral side 115 and medial side 117 can extend through forefoot region 111, midfoot region 112, and heel region 114 in some embodiments. Lateral side 115 and medial side 117 can correspond with opposite sides of footwear 100. More particularly, lateral side 115 can correspond with an outside area of the wearer's foot (i.e. the surface that faces away from the other foot), and medial side 117 can correspond with an inside area of the wearer's foot (i.e., the surface that faces toward the other foot). Forefoot region 111, midfoot region 112, heel region 114, lateral side 115, and medial side 117 are not intended to demarcate precise areas of footwear 100. Rather, forefoot region 111, midfoot region 112, heel region 114, lateral side 115, and medial side 117 are intended to represent general areas of footwear 100 to aid in the following discussion.

Footwear 100 can also extend along various axes. For example, as shown in FIGS. 1-4, footwear 100 can extend along a longitudinal axis 105, a transverse axis 106, and a vertical axis 107. Longitudinal axis 105 can extend generally between heel region 114 and forefoot region 111. Transverse axis 106 can extend generally between lateral side 115 and medial side 117. Also, vertical axis 107 can extend substantially perpendicular to both longitudinal axis 105 and transverse axis 106. It will be appreciated that longitudinal axis 105, transverse axis 106, and vertical axis 107 are merely included for reference purposes and to aid in the following discussion.

Embodiments of sole structure 110 will now be discussed with reference to FIGS. 1 and 2. Sole structure 110 can be secured to upper 120 and can extend between the wearer's foot and the ground when footwear 100 is worn. Sole structure 110 can be a uniform, one-piece member in some embodiments. Alternatively, sole structure 110 can include multiple components, such as an outsole, a midsole, and an insole, in some embodiments.

Also, as shown in FIGS. 1 and 2, sole structure 110 can include a ground-engaging surface 104. Ground-engaging surface 104 can also be referred to as a ground-contacting surface. Furthermore, sole structure 110 can include an upper surface 108 that faces the upper 120. Stated differently, upper surface 108 can face in an opposite direction from the ground-engaging surface 104. Upper surface 108 can be attached to upper 120. Also, sole structure 110 can include a side peripheral surface 109 that extends between ground engaging surface 104 and upper surface 108. Side peripheral surface 109 can extend generally along vertical axis 107. Side peripheral surface 109 can also extend substantially continuously about footwear 100 between forefoot region 111, lateral side 115, heel region 114, and medial side 117.

Embodiments of upper 120 will now be discussed in greater detail with reference to FIGS. 1-4. Upper 120 is shown with sole structure 110 in FIGS. 1 and 2, but upper 120 is shown without sole structure 110 in FIGS. 3 and 4.

As shown, upper 120 can define a void 122 that receives a foot of the wearer. Stated differently, upper 120 can define an interior surface 121 that defines void 122, and upper 120 can define an exterior surface 123 that faces in a direction opposite interior surface 121. When the wearer's foot is received within void 122, upper 120 can at least partially enclose and encapsulate the wearer's foot. Thus, upper 120 can extend about forefoot region 111, lateral side 115, heel region 114, and medial side 117 in some embodiments.

Upper 120 can also include a collar 124. Collar 124 can include a collar opening 126 that is configured to allow passage of the wearer's foot during insertion or removal of the foot from void 122.

Upper 120 can also include a throat 128. Throat 128 can extend from collar opening 126 toward forefoot region 111. Throat 128 dimensions can be varied to change the width of footwear 100 between lateral side 115 and medial side 117 in some embodiments. Thus, throat 128 can be configured for changing fit of article of footwear 100.

In some embodiments, such as the embodiment of FIGS. 1-4, throat 128 can be a "closed" throat 128, in which upper 120 is substantially continuous and uninterrupted between lateral side 115 and medial side 117. In other embodiments, throat 128 can include a throat opening between lateral side 115 and medial side 117. In these latter embodiments, footwear 100 can include a tongue that is disposed within throat opening. For example, in some embodiments, the tongue can be attached at its forward end to forefoot region 111, and the tongue can be detached from lateral side 115 and lateral side 117. Accordingly, the tongue can substantially fill the throat opening.

In some embodiments, footwear 100 can additionally include a securement device 130 as shown in FIG. 1. Securement device 130 can be used by the wearer to adjust the dimensions of the footwear 100. For example, securement device 130 can be used by the wearer to selectively vary the girth, or width of footwear 100. Securement device 130 can be of any suitable type, such as a shoelace, a strap, a buckle, or any other device. In the embodiment of FIG. 1, for example, securement device 130 can include a shoelace 131 that is secured to both lateral side 115 and medial side 117. By tensioning securement device 130, lateral side 115 and medial side 117 can be pulled toward each other to tighten footwear 100 onto the wearer's foot. As such, footwear 100 can be tightly secured to the wearer's foot. By reducing tension in securement device 130, footwear 100 can be loosened, and footwear 100 can be easier to put on or remove from the wearer's foot. It will be appreciated that securement device 130 and shoelace 131 are optional. Thus, footwear 100 may not include securement device 130 or shoelace 131 in some embodiments.

Footwear 100 can additionally include one or more areas, members, parts, or features that provide compression force to the wearer's foot when footwear 100 is worn. For purposes of discussion, this type of feature will be referred to as a "compression member," which is identified generally at 291 in FIGS. 1 and 2. Compression member 291 can compress against the wearer's body in order to secure footwear 100 to the wearer. Compression member 291 can also be elastic and resilient in some embodiments. Compression member 291 can, in some embodiments, allow resilient flexure of upper 120, and the resilience of compression member 291 can bias upper 120 to recover and compress against the wearer's foot to further secure footwear 100.

Compression member 291 can be included in any suitable location on upper 120. For example, in some embodiments, compression member 291 can be included in and/or can at least partially define collar 124. In additional embodiments, compression member 291 can be included in and/or can at least partially define throat 128. In still other embodiments, different portions of upper 120 can provide different amounts of compression to the wearer's foot, and at least one of these portions can be considered to be the compression member 291. These and other embodiments will be discussed in greater detail below.

Additionally, footwear 100 can include a selection element 132. As will be explained in detail below, selection element 132 can be used by wearer to select and vary the amount of compression force applied by the compression member 291. Accordingly, selection element 132 can be used to make footwear 100 fit tighter on the foot, and selection element 132 can be used to loosen footwear 100 from the wearer's foot. Also, as will be discussed, selection element 132 can be included in a convenient and effective location on footwear 100.

For example, in some embodiments, selection element 132 can be adjacent and/or proximate to compression member 291. In some embodiments, selection element 132 can include two or more areas that move relative to each other to vary the compression applied by compression member 291.

In some embodiments, for example, compression member 291 can be located generally at collar 124 and throat 128, and selection element 132 can be located proximate collar 124 and throat 128. Also, in some embodiments, selection element 132 can include one or more features that help the user to grasp and/or otherwise manipulate selection element 132. For example, selection element 132 can include a tab or other handling feature that facilitates adjustment of the compression applied by compression member 291.

Portions of selection element 132 can further be substantially integrated into upper 120 in some embodiments. As such, selection element 132 can be substantially inconspicuous. Manufacture of footwear 100 can also be facilitated because selection element 132 can be integrated into adjacent portions of upper 120.

For example, in some embodiments, upper 120 can be at least partially defined by a knitted component 134. Knitted component 134 is shown according to exemplary embodiments in FIGS. 11 and 12. Knitted component 134 can be formed of a unitary knit construction as will be discussed. Also, knitted component 134 can at least partially define selection element 132 in some embodiments. Stated differently, at least a portion of selection element 132 can be formed of unitary knit construction with adjacent portions of knitted component 134. Accordingly, selection element 132 can be manufactured efficiently as will be discussed. Also, selection element 132 can have robust construction and is unlikely to detach from upper 120 because of the unitary knit construction with adjacent portions of knitted component 134. Moreover, selection element 132 can be relatively inconspicuous because selection element 132 can be substantially integrally formed with knitted component 134.

Knitted Component Configurations

Many conventional footwear uppers are formed from multiple material elements that are joined through stitching or bonding, for example. In contrast, in some embodiments, upper 120 can be at least partially formed from knitted component 134. Knitted component 134 can have any suitable shape and size. Knitted component 134 can be formed of unitary knit construction as a one-piece element. As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses or wales of yarn or other knit material that are joined such that the structures or elements include at least one course or wale in common (i.e., sharing a common yarn) and/or include courses or wales that are substantially continuous between each of the structures or elements. With this arrangement, a one-piece element of unitary knit construction is provided. In the exemplary embodiments, any suitable knitting process may be used to produce knitted component 134 formed of unitary knit construction, including, but not limited to a flat knitting process, such as warp knitting or weft knitting, as well as a circular knitting process, or any other knitting process suitable for providing a knitted component. Examples of various configurations of knitted components and methods for forming knitted component 134 with unitary knit construction are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al., each of which is entirely incorporated herein by reference.

Figure 18:
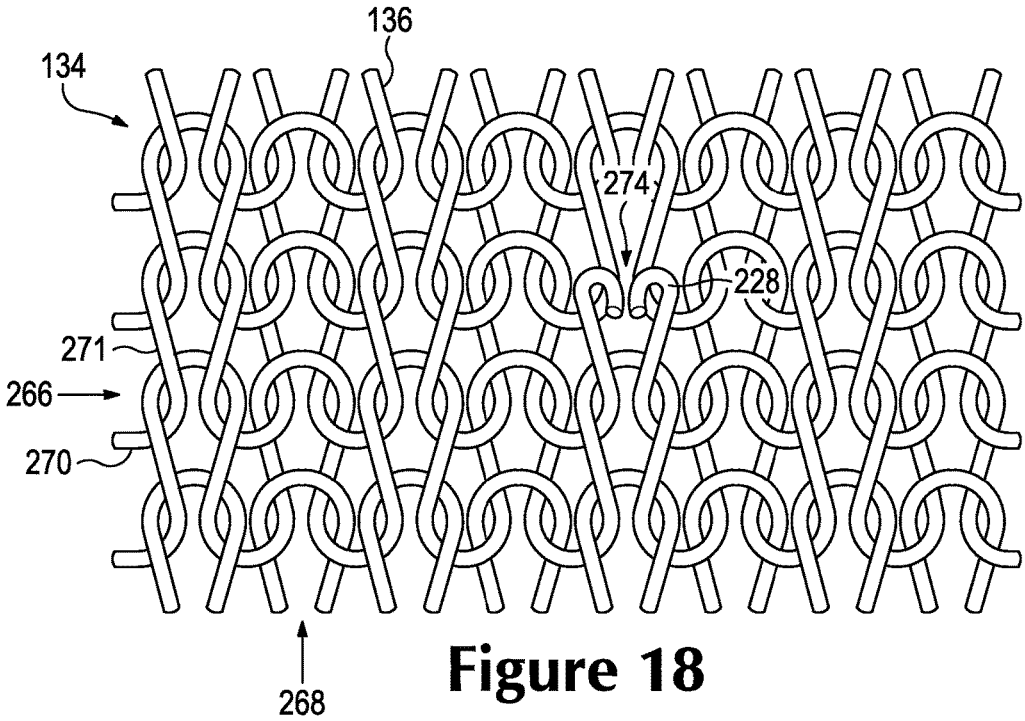
FIG. 18 is a detail view of a portion of the knitted component of FIGS. 11 and 12.

Knitted component 134 can be formed from at least one yarn, cable, monofilament, or other flexible and elongate strand that is manipulated (e.g., with a knitting machine) to form a variety of interconnected loops. For example, as shown in FIG. 18, knitted component 134 can include at least one strand 270 that has been manipulated to form a number of loops 271. Loops 271 can be arranged in a row, or course 266, which extends horizontally as viewed in FIG. 18. Adjacent loops 271 within different courses 266 can be interconnected and arranged in wales 268, which extend vertically as viewed in FIG. 18. It will be appreciated that knitted component 134 can include any suitable type of stitches, including loop stitches, tuck stitches, or other types. Thus, adjacent areas of knitted component 134 can share at least one common course 266 or at least one common wale 268. That is, knitted component 134 can have the structure of a knit textile.

Figure 19:
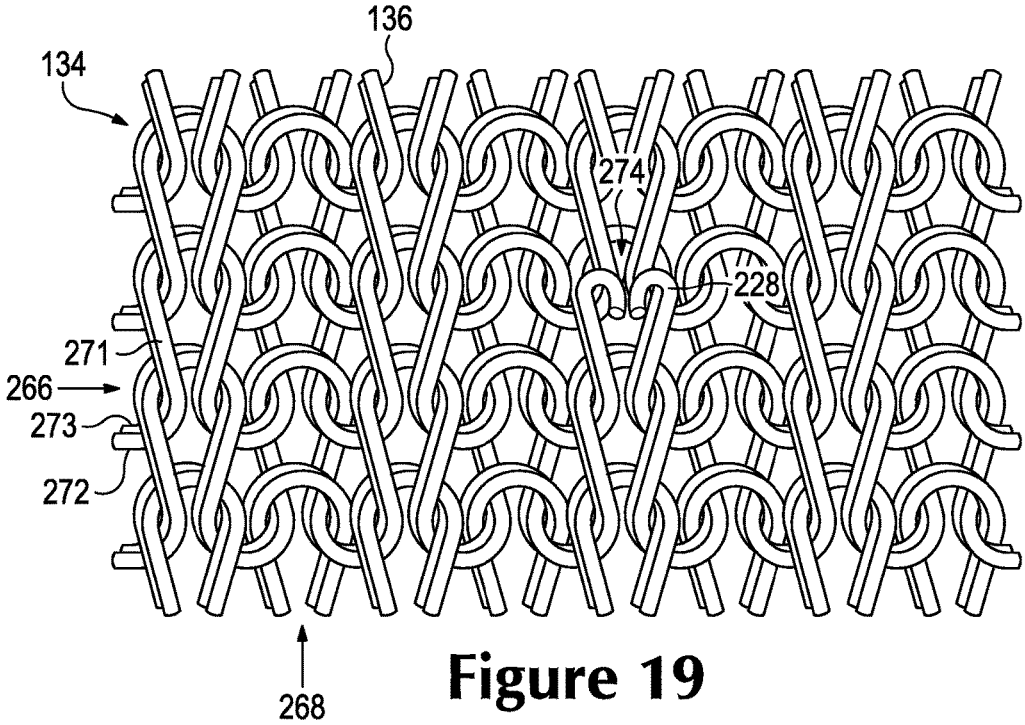
FIG. 19 is a detail view of a portion of the knitted component of FIGS. 11 and 12 according to an additional embodiment.

FIG. 19 illustrates an additional exemplary embodiment of knitted component 134. As shown, a first strand 272 and a second strand 273 can be included. First strand 272 and second strand 273 can be substantially overlapped. As such, individual loops 271 can include both first strand 272 and second strand 273.

Knitted component 134 may incorporate various types and combinations knit structures. For example, in some embodiments, the strands forming knitted component 134 may have one type of stitching in one area and another type of stitching in another area. Depending upon the types and combinations utilized, areas of knitted component 134 may have a plain knit structure, a mesh knit structure, or a rib knit structure, for example. The different types of knit structures may affect the physical properties of knitted component 134, including aesthetics, stretch, thickness, air permeability, and abrasion-resistance of knitted component 134. That is, the different types of knit structures may impart different properties to different areas of knitted component 134. Also, in some embodiments, knitted component 134 may have one type of strand in one area and another type of strand in another area. Depending upon various design criteria, knitted component 134 may incorporate strands with different deniers, materials (e.g., cotton, elastane, polyester, rayon, wool, and nylon), and degrees of twist, for example. The different types of strands may affect the physical properties of knitted component 134, including aesthetics, stretch, thickness, air permeability, and abrasion-resistance of knitted component 134. That is, the different types of strands may impart different properties to different areas of knitted component 134. By combining various types and combinations of stitches and strands, each area of knitted component 134 may have specific properties that enhance the comfort, fit, durability, and/or performance of footwear 100.

Also, one or more of the strands within knitted component 134 may be partially formed from a thermoplastic polymer material, which softens or melts when heated and returns to a solid state when cooled. For example, in some embodiments, second strand 273 of FIG. 19 can be formed from thermoplastic polymer material while first strand 272 is a yarn formed from cotton or other material. The thermoplastic polymer material can transition from a solid state to a softened or liquid state when subjected to sufficient heat, and then the thermoplastic polymer material can transition from the softened or liquid state to the solid state when sufficiently cooled. As such, the thermoplastic polymer materials within the stand can be used to join two objects or elements together as will be discussed in greater detail below. The thermoplastic material can also be used to strengthen, reinforce, or rigidify portions of knitted component 134 in some embodiments. Knitted component 134 can incorporate these so-called "fusible" yarns according to co-owned U.S. Pat. No. 6,910,288, which issued on Jun. 28, 2005 to Dua, and which the disclosure of is incorporated by reference in its entirety.

Figure 11:
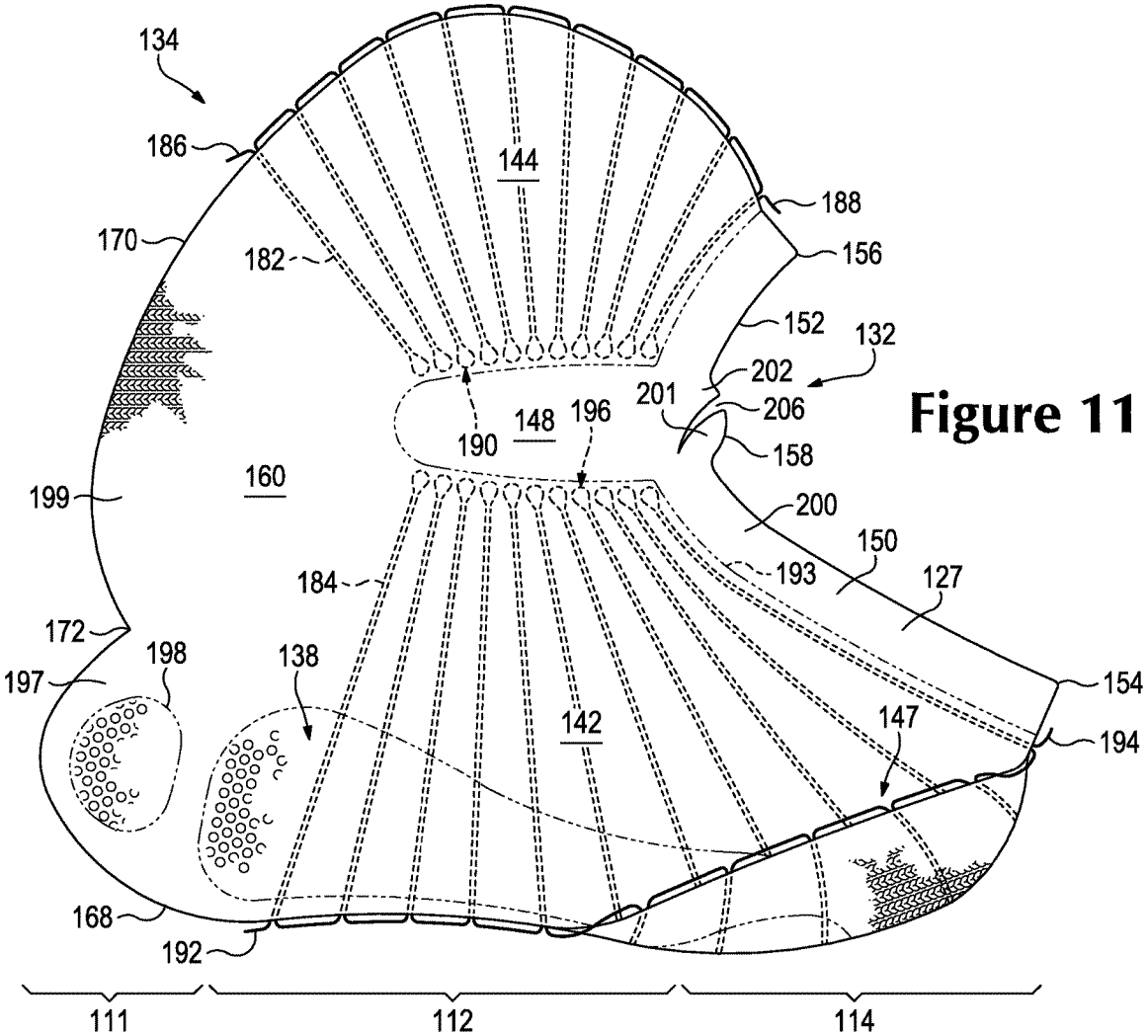
FIG. 11 is a plan view of a knitted component of the upper of the article of footwear of FIG. 1, wherein the inner surface of the knitted component is primarily shown.
Figure 12:
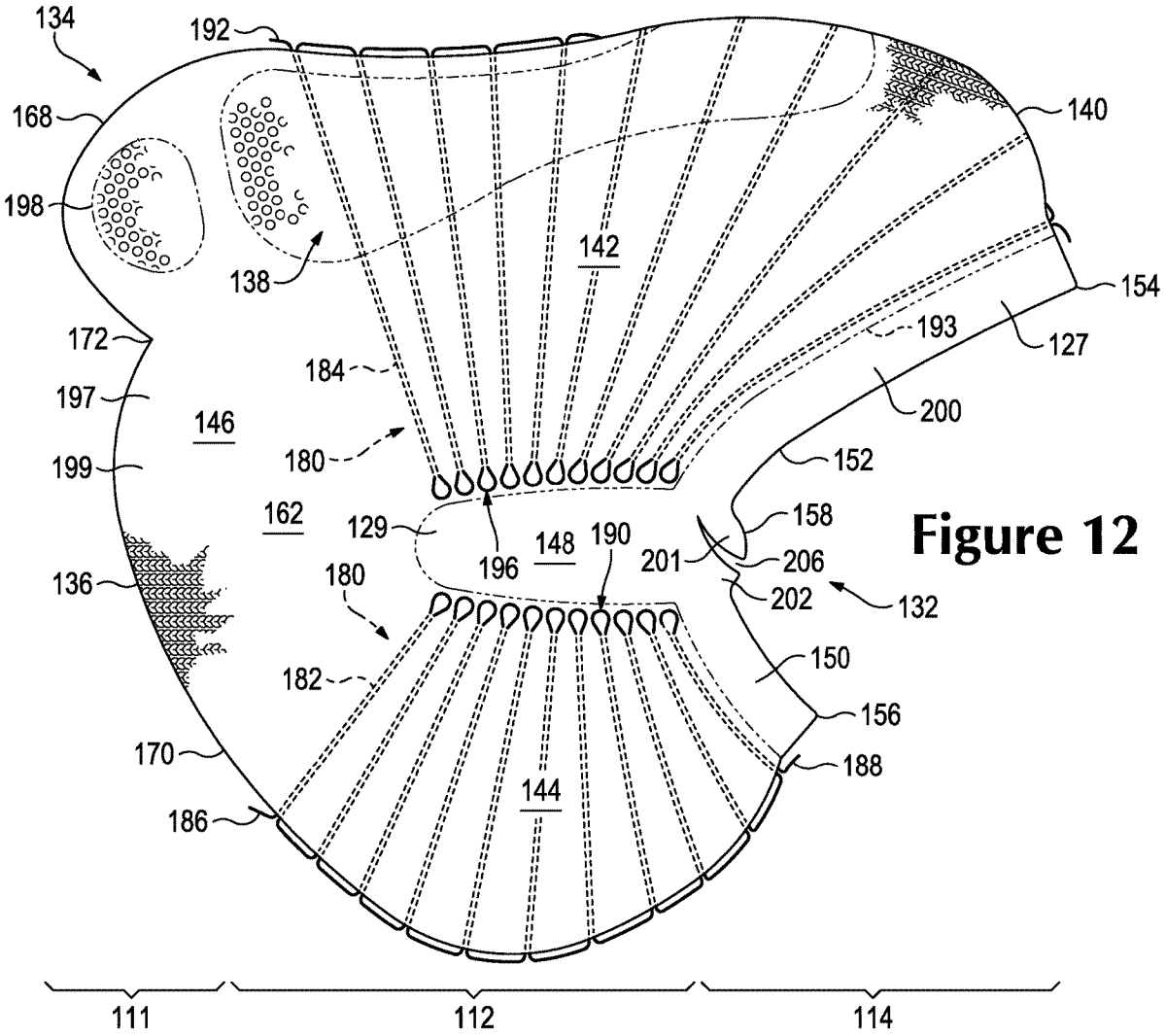
FIG. 12 is a plan view of the knitted component, wherein the outer surface of the knitted component is primarily shown.

Exemplary embodiments of knitted component 134 are shown in an assembled state in FIGS. 1-3 and in an unassembled, plan view in FIGS. 11 and 12. It will be appreciated, however, that knitted component 134 could vary from these illustrated embodiments without departing from the scope of the present disclosure. Generally, knitted component 134 can include a knit element 136 and one or more tensile strands 180. In some embodiments, knitted component 134, knit element 136, and tensile strands 180 can be constructed according to U.S. patent application Ser. No. 14/026,589, filed Sep. 13, 2013, the disclosure of which is incorporated by reference in its entirety.

In some embodiments, knit element 136 can define a majority of upper 120. More specifically, as shown in FIGS. 1-3, 11, and 12, knit element 136 can include a lateral portion 142 and a medial portion 144. Lateral portion 142 can substantially define lateral side 115 of upper 120 while medial portion 144 can substantially define medial side 117 of upper 120. Also, knit element 136 can include a heel portion 140 and a forefoot portion 146. Heel portion 140 can substantially define heel region 114 of upper 120 while forefoot portion 146 can substantially define forefoot region 111 of upper 120. Furthermore, as shown in FIGS. 3, 11, and 12, knit element 136 can include a base portion 138, which can also be referred to as a strobel portion or underfoot portion. Base portion 138 can extend between medial portion 144 and lateral portion 142, and base portion 138 can also extend between forefoot portion 146 and heel portion 140. Heel portion 140, lateral portion 142, medial portion 144, and forefoot portion 146 can each be formed of unitary knit construction with base portion 138 in some embodiments.

Still further, knit element 136 can include a throat portion 148 in some embodiments. Throat portion 148 can be disposed between lateral portion 142 and medial portion 144. In some embodiments, throat portion 148 can be integrally attached to and formed of unitary knit construction with lateral portion 142, medial portion 144, and forefoot portion 146. Throat portion 148 can substantially define throat 128 of upper 120.

Knit element 136 can further include a collar portion 150 that can substantially define collar 124 of upper 120. Collar portion 150 can include a rim 152. Rim 152 can define collar opening 126 within upper 120 in some embodiments. Also, in some embodiments, rim 152 can include a protrusion 158. Protrusion 158 can be rounded and convex in some embodiments. Also, protrusion 158 can be substantially centered with respect to throat portion 148 such that protrusion 158 protrudes away from throat portion 148.

As shown in the plan view of FIG. 11, knit element 136 can further include an inner surface 160. Also, as shown in FIG. 12, knit element 136 can include an outer surface 162. In some embodiments, inner surface 160 can define interior surface 121 of upper 120 and/or outer surface 162 can define exterior surface 123 of upper 120. Still further, knit element 136 can include a first peripheral edge 168 and a second peripheral edge 170, which are shown in FIGS. 11 and 12. First peripheral edge 168 and second peripheral edge 170 can meet at a junction 172. Also, first peripheral edge 168 and rim 152 can meet at a first corner 154. Second peripheral edge 170 and rim 152 can meet at a second corner 156. As shown, first peripheral edge 168 can extend continuously between junction 172 and first corner 154. Also, second peripheral edge 170 can extend continuously between junction 172 and second corner 156. Moreover, rim 152 can extend continuously between first corner 154 and second corner 156. Furthermore, first peripheral edge 168, second peripheral edge 170, and/or rim 152 can be curved in some embodiments.

Portions of knit element 136 can have three dimensional curvature and/or three dimensionally contoured surfaces in some embodiments. For example, as shown in FIGS. 11 and 12, inner surface 160 of knit element 136 at heel portion 140 can have three dimensional concave curvature. As such, heel portion 140 of knit element 136 can define a heel cavity 147. Heel cavity 147 can be configured for receiving at least a portion of the wearer's heel. It will be appreciated that other portions of knit element 136 can also have three dimensional curvature and can define a respective cavity in additional embodiments.

Areas of knit element 136 can be attached to other areas to form a three dimensional, hollow body that corresponds in shape to upper 120. For example, first peripheral edge 168 can be joined to second peripheral edge 170 to define a seam 173 of knitted component 134 and upper 120. Portions of seam 173 are shown in FIGS. 1-3 according to exemplary embodiments. It will be appreciated that seam 173 can be defined in and can extend over any suitable area of upper 120. For example, seam 173 can include a first end 171 and a second end 175, and seam 173 can extend continuously between first end 171 and second end 175. More specifically, in some embodiments, first end 171 of seam 173 can be disposed generally at the rim 152 on medial side 117 of upper 120, and second end 175 of seam 173 can be disposed generally in the forefoot region 111 of upper 120, adjacent lateral side 115. Between first end 171 and second end 175, seam 173 can extend downward from rim 152 toward sole structure 110, forward along longitudinal axis 105 toward forefoot region 111, and upward into forefoot region 111.

As mentioned above, knitted component 134 can also include one or more tensile strands 180. Tensile strands 180 can be attached to knit element 136. For example, tensile strands 180 can be inlaid within one or more courses 266 or wales 268 of knit element 136. Tensile strands 180 can also be inlaid and located within knitted component 134 while knit element 136 is being formed. Thus, in some embodiments, tensile strands 180 can be inlaid during the knitting process when forming knitted component 134.

In various embodiments, there can be any suitable number of tensile strands 180, and the strand 180 can extend across any portion of knitted component 134. For example, as shown in FIGS. 11 and 12, knitted component 134 can include a first tensile strand 182 and a second tensile strand 184. First tensile strand 182 can be coupled to lateral portion 142 of knit element 136 to be disposed on lateral side 115 of upper 120. Second tensile strand 184 can be coupled to medial portion 144 of knit element 136 to be disposed on medial side 117 of upper 120. First tensile strand 182 and/or second tensile strand 184 can also be coupled to and can extend over heel portion 140, forefoot portion 146, and/or base portion 138 of knit element 136 in some embodiments.

In the embodiment of FIGS. 11 and 12, for example, first tensile strand 182 can include a first end 186 and a second end 188. First end 186 can extend from second peripheral edge 170 in midfoot region 112. Second end 188 can extend from second peripheral edge 170 in heel region 114. In between first end 186 and second end 188, first tensile strand 182 can extend in a serpentine fashion, back and forth between throat portion 148 and second peripheral edge 170. First tensile strand 182 can also define a plurality of first loops 190 as shown in FIG. 12. Loops 190 can be exposed from knit element 136. First loops 190 can be aligned along medial portion 144, adjacent throat portion 148.

Second tensile strand 184 can include a first end 192 and a second end 194. First end 192 can extend from first peripheral edge 168 in midfoot region 112. Second end 194 can extend from first peripheral edge 168 in heel region 114. In between first end 186 and second end 188, second tensile strand 184 can extend in a serpentine fashion, back and forth between throat portion 148 and first peripheral edge 168. Second tensile strand 184 can also define a plurality of second loops 196 as shown in FIG. 12. Second loops 196 can be aligned along lateral portion 142, adjacent throat portion 148.

As shown in FIG. 1, shoelace 131 can attach to first loops 190 and second loops 196. More specifically, shoelace 131 can zig-zag back and forth between first loops 190 on medial side 117 and second loops 196 on lateral side 115.

Thus, as shoelace 131 is tightened and tension in shoelace 131 is increased, lateral side 115 and medial side 117 can be drawn together, and the footwear 100 can be tightened on the wearer's foot. Conversely, as the shoelace 131 is loosened and tension is decreased, lateral side 115 and medial side 117 can be released from each other. This can facilitate removal of footwear 100.

Knit element 136 can also include two or more areas having different characteristics. For example, some portions of knit element 136 can be substantially continuous, while other areas can include a plurality of openings. As shown in the embodiment of FIGS. 11 and 12, base portion 138 can include one or more perforated zones 198, which are surrounded by substantially continuous zones 197. The perforated zones 198 can include a series of openings of consistent size. Thus, perforated zone 198 can have a mesh-type of appearance. In contrast, continuous zones 197 can have a substantially continuous, uninterrupted appearance.

Also, some areas of knit element 136 can have greater elasticity than other areas. For example, the elasticity of portions of knit element 136 may be varied by choice of knit type, yarn type, or stitch density, as well as a combination of any one or more of these characteristics.

In the embodiments of FIGS. 11 and 12, knit element 136 can have a first region 199 having a first elasticity. Knit element 136 can have a second region 200 having a second elasticity. The first elasticity can be different from the second elasticity. For example, in some embodiments, the second region 200 can stretch more than the first region 199 due to the different elasticity. Second region 200 can be elastic while first region 199 can be substantially stiff in some embodiments. Also, second region 200 can be elastic and readily stretchable while first region 199 can be less elastic and can resist stretching in some embodiments.

First region 199 and second region 200 can be disposed in any suitable location on upper 120. For example, second region 200 can be disposed proximate collar portion 150 of knit element 136. Also, in some embodiments, second region 200 can be disposed proximate throat portion 148 of knit element 136. An exemplary boundary or transition between first region 199 and second region 200 is represented in FIGS. 11 and 12 with a broken line 193. Thus, as shown in the illustrated embodiments, second region 200 can have a collar portion 127 and a throat portion 129. Collar portion 127 can extend along collar portion 150 of knit element 136 between first peripheral edge 168 and second peripheral edge 170. Throat portion 129 can extend from rim 152 and along throat portion 148. The increased elasticity of second region 200 as compared with first region 199 can facilitate the act of putting on and taking off footwear 100.

It will be appreciated that second region 200 can at least partially the above-mentioned compression member 291 of upper 120. Thus, second region 200 can apply compression to the wearer's foot. Furthermore, as will be discussed, selection element 132 can be used to vary and select the amount of compression provided by second region 200.

Selection Element Configurations

Exemplary embodiments of selection element 132 will be discussed in detail with reference to FIGS. 1-10. As will be explained, selection element 132 can be used to vary the fit of footwear 100. For example, selection element 132 can be used to select and vary the amount of compression that the upper 120 applies to the wearer's foot, ankle, lower leg, and/or other area of the wearer's body.

Also, as mentioned above, upper 120 can include and can be at least partially defined by knitted component 134. In some embodiments, knitted component 134 can define at least a portion of selection element 132. As such, selection element 132 can be at least partially formed of unitary knit construction with adjacent portions of knitted component 134. Selection element 132 is, thus, unlikely to detach from knitted component 134. Also, selection element 132 can be relatively compact and inconspicuous. Moreover, selection element 132 can be manufactured in an efficient manner as will be discussed in greater detail below.

In some embodiments, selection element 132 can include a first area 201 and a second area 202. First area 201 and second area 202 can be moved relative to each other between two or more positions. For example, in some embodiments, first area 201 and second area 202 can be spaced away from each other in one position. First area 201 and second area 202 can also be adjacent each other in another position. Upper 120 can be looser or tighter depending on the position of the first area 201 relative to second area 202. Thus, compression applied to the wearer's body can be varied by changing the position of first area 201 relative to second area 202.

Figure 8:
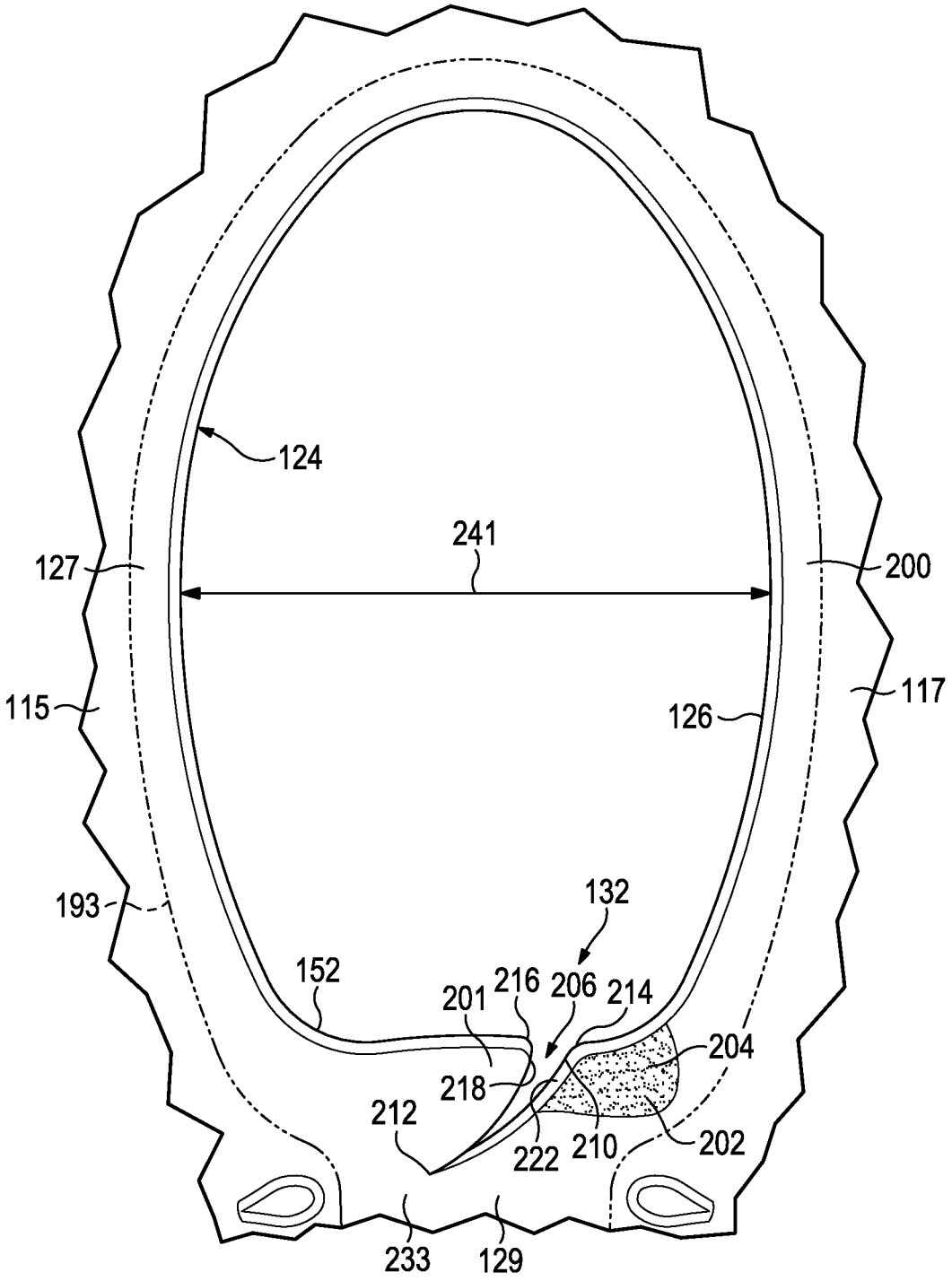
FIG. 8 is a top view of the selection element in the unsecured position.
Figure 9:
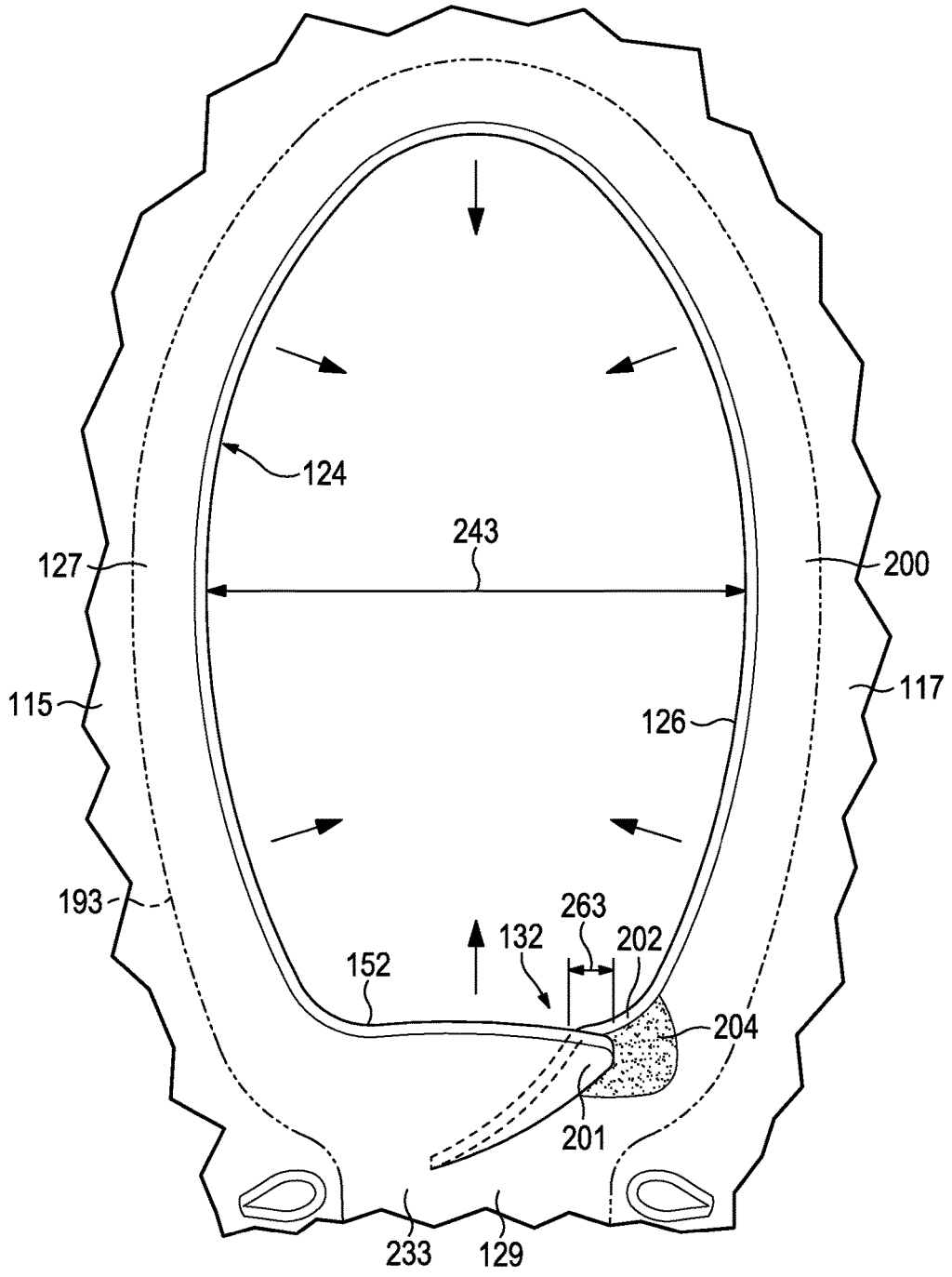
FIG. 9 is a top view of the selection element in the first secured position.
Figure 10:
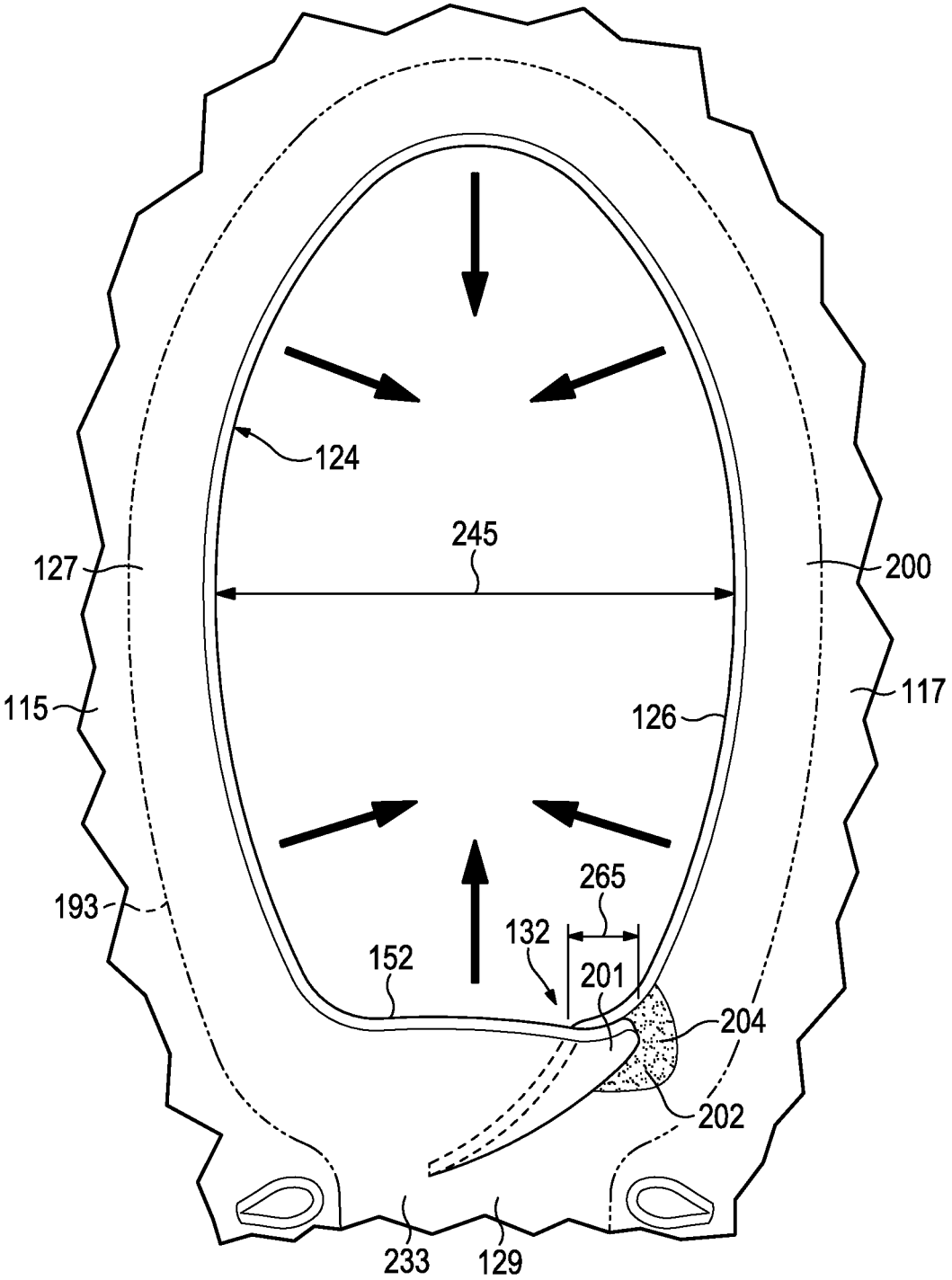
FIG. 10 is a top view of the selection element in the second secured position.

In some embodiments, first area 201 can be spaced away from second area 202 in a first position, and first area 201 and second area 202 can overlap each other in a second position. For example, first area 201 is shown spaced away from second area 202 in FIG. 8. In contrast, first area 201 and second area 202 overlap as shown in FIGS. 9 and 10. First area 201 overlaps second area 202 by a first overlap distance 263 in FIG. 9, and first area 201 overlaps second area 202 by a second overlap distance 265 in FIG. 10 according to various embodiments. By moving first area 201 relative to second area 202 in this way, the user can change the volume of void 122 within upper 120. Thus, this can change the amount of compression applied by upper 120 to the wearer's body.

Moreover, in some embodiments, selection element 132 can include an attachment member 204. Attachment member 204 can be configured to secure first area 201 to second area 202 in some embodiments. Thus, selection element 132 can have a secured position in which attachment member 204 secures first area 201 and second area 202 together. Also, in some embodiments, selection element 132 can have an unsecured position in which first area 201 is unsecured from second area 202.

Furthermore, in some embodiments, attachment member 204 can secure first area 201 and second area 202 together in a first secured position and also in a second secured position. When in the first secured position, compression member 291 can apply a first amount of compression, and when in the second secured position, compression member 291 can apply a second amount of compression that is different from the first amount of compression. It will be appreciated that selection element 132 can have any number of predetermined secured positions, and the amount of compression applied by compression member 291 of upper 120 can be different in each position.

Additionally, in some embodiments, selection element 132 can be included within or adjacent an area of upper 120 that is resilient, elastic, and stretchable. Also, in some embodiments, movement of selection element 132 between unsecured position and secured position(s) can cause resilient stretching of these elastic areas of upper 120. The resiliency of these areas can cause upper 120 to apply increased compression onto the wearer's body. In some embodiments, elastic regions that are stretched by selection element 132 can be relatively large and/or can span across relatively large areas of the wearer's body. Accordingly, compression forces from upper can be distributed across relatively large areas of the wearer's body. Thus, upper 120 can fit comfortably and securely to the wearer's body.

Furthermore, in some embodiments, selection element 132 can include an opening 206. Opening 206 can be defined between first area 201 and second area 202. Stated differently, opening 206 can separate first area 201 from second area 202. Opening 206 can be a slit, a hole, a recess, or another type of aperture. Opening 206 can allow for increased range of movement of first area 201 relative to second area 202. Accordingly, compression forces applied by upper 120 can be varied across a relatively wide range by using selection element 132. It will be appreciated, however, that opening 206 is optional, and selection element 132 may not include opening 206 in some embodiments.

The illustrated embodiments of first area 201, second area 202, attachment member 204, opening 206, and other features of selection element 132 will now be discussed with reference to FIGS. 1-10. As shown, selection element 132 can be at least partially incorporated in knitted component 136 and can be formed of unitary knit construction with adjacent portions of knitted component 136. However, it will be appreciated that selection element 132 can be independent of knitted component 136 without departing from the scope of the present disclosure. Also, it will be appreciated that, in some embodiments, selection element 132 can be incorporated in an upper 120 that does not include a knitted component.

Opening 206, first area 201, and second area 202 can have any suitable shape and dimensions. Also, opening 206, first area 201, and second area 202 can be disposed in any suitable location in upper 120.

In some embodiments, selection element 132 can be spaced from sole structure 110. More specifically, as shown in the embodiments of FIGS. 3 and 8, first area 201 can be disposed adjacent collar 124 of upper 120. In some embodiments, first area 201 can be defined by rim 152 of collar 124 and by a first area edge 218. Also, second area 202 can be disposed adjacent collar 124 in some embodiments. Second area 202 can be defined by rim 152 of collar 124 and by a second area edge 222. In some embodiments, first area 201 can be disposed closer to lateral side 115, and second area 202 can be disposed closer to medial side 117.

Furthermore, opening 206 can be defined between first area edge 218 and second area edge 222. In some embodiments, opening 206 can be a relatively narrow slit having a first end 210 and a second end 212. First end 210 can be open to collar opening 126 in some embodiments as shown in FIG. 8. Additionally, first end 210 of opening 206 can be defined by a first transition 216 between rim 152 and first area edge 218. First end 210 of opening 206 can also be defined by a second transition 214 between rim 152 and second area edge 222. First transition 216 and/or second transition 214 can be rounded as shown in FIGS. 3 and 8. In additional embodiments, first transition 216 and/or second transition 214 can be pointed and angular. Second end 212 of opening 206 can be defined at an area in which first area edge 218 and second area edge 222 meet.

Opening 206 can also extend from rim 152 generally toward sole structure 110. Also, in some embodiments, opening 206 can curve between first end 210 and second end 212. For example, as shown in FIGS. 3 and 8, opening 206 can curve toward lateral side 115 in some embodiments. As such, second end 212 can be disposed closer to lateral side 115 than medial side 117. Also, because of this curvature, first area 201 of selection element 132 can protrude from surrounding portions of upper 120 on lateral side 115. Thus, first area 201 can be a tab or a tab-shaped area of upper 120 that can be easily grasped and moved relative to second area 202.

As shown in FIGS. 11 and 12, first area 201 can be integrally connected to surrounding portions of knit element 136 in some embodiments. Accordingly, first area 201 can be formed of unitary knit construction with adjacent portions of collar portion 150 of knit element 136. Also, first area 201 can partially define inner surface 160 and outer surface 162 of knit element 136 in some embodiments.

Likewise, in some embodiments, second area 202 can be integrally connected to surrounding portions of knit element 136. Accordingly, second area 202 can be formed of unitary knit construction with adjacent portions of collar portion 150 of knit element 136. Also, second area 202 can partially define inner surface 160 and outer surface 162 of knit element 136 in some embodiments.

Figure 4:
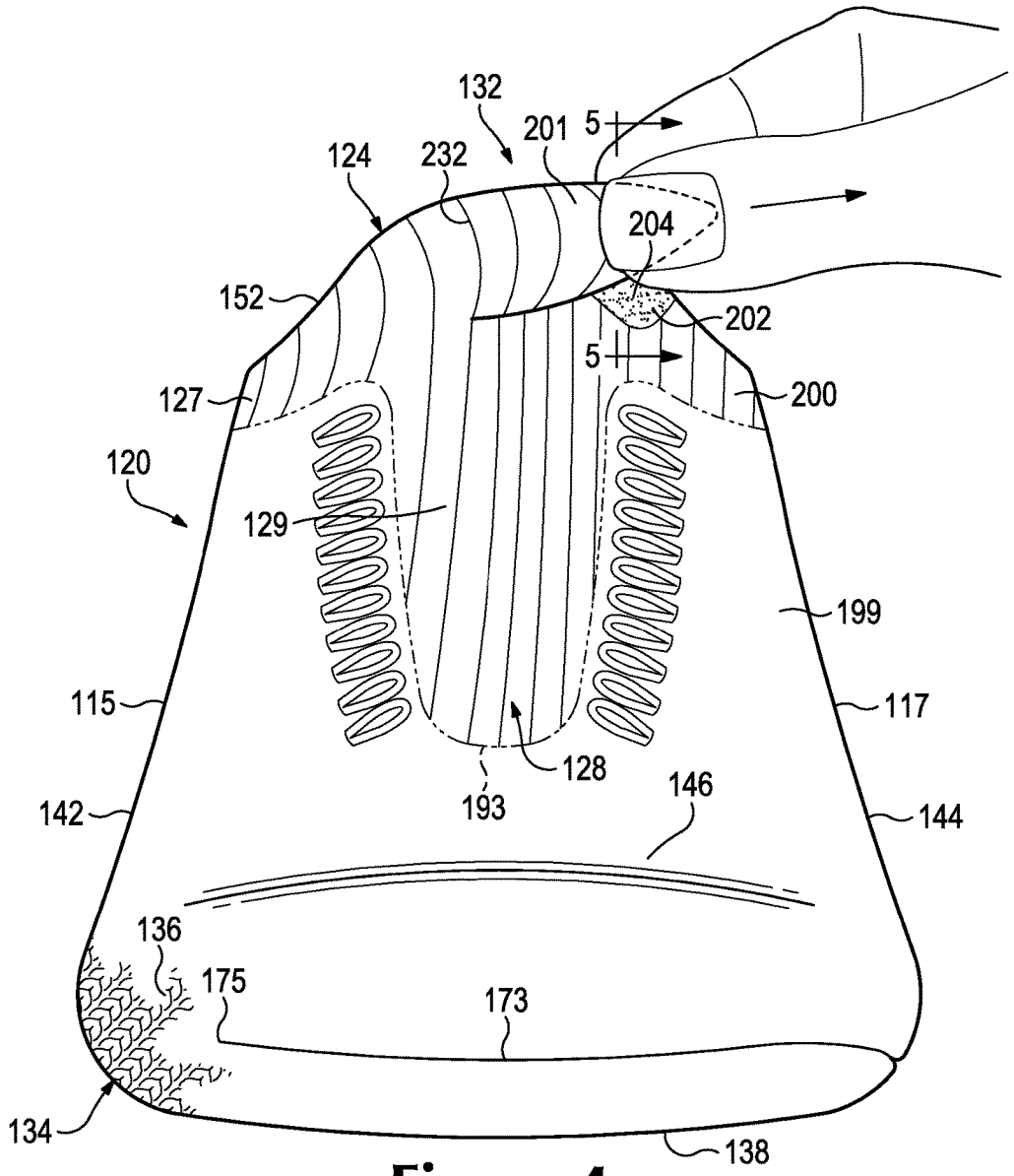
FIG. 4 is a front view of the upper of FIG. 3, wherein a user is shown manipulating the selection element.

As shown in FIGS. 3 and 8, first area 201, second area 202, and opening 206 of selection element 132 can be disposed on protrusion 158 of knit element 136 in some embodiments. Thus, in some embodiments, selection element 132 can be substantially centered with respect to throat 128 of upper 120. Accordingly, selection element 132 can be easily accessible by the wearer. More specifically, selection element 132 can be grasped easily by one or both of the wearer's hands as shown in FIG. 4, even while footwear 100 is being worn. Also, selection element 132 can be visible to the wearer during use due to this location.

However, it will be appreciated that selection element 132 could be disposed in other locations without departing from the scope of the present disclosure. For example, selection element 132 can be located at medial side 117 of collar 124 in some embodiments. In other embodiments, selection element 132 can be located at lateral side 115 of collar 124. In still other embodiments, selection element 132 can be located at heel region 114 of collar 124. Also, in some embodiments, selection element 132 can be spaced away from collar 124. For example, selection element 132 can be located in forefoot region 111 in some embodiments for varying compression within forefoot region 111. Selection element 132 can also be included in other regions of upper 120 as well without departing from the scope of the present disclosure.

Moreover, an adjacent region 233 of upper 120 can be defined proximate and/or can surround first area 201, second area 202, and opening 204 of selection element 132. In the embodiments of FIGS. 3 and 8, region 233 can be defined within collar 124 and/or throat 128 of upper 120. Region 233 can be substantially continuous. Stated differently, selection element 132 can be a "divided region" of knitted component 134 due to opening 204 while region 233 can be an "undivided region" that is spaced from opening 204. As shown in the illustrated embodiments of FIGS. 3 and 8, region 233 can surround selection element 132. Thus, region 233 can extend from first area 201, about collar 124, to second area 202. Region 233 can also extend from second end 212 of opening 204 to sole structure 110. As will be discussed, movement of first area 201 relative to second area 202 can pull at least partially on adjacent region 233 to apply compression to the wearer's body.

As stated above, knit element 136 of upper 120 can include a second region 200 having increased elasticity compared to first region 199. As shown in the embodiments of FIGS. 1-4, first area 201 and second area 202 can be disposed proximate second region 200. In some embodiments, first area 201 and second area 202 can be defined within second region 200. Also, adjacent region 233 can be at least partially coextensive with second region 200 in some embodiments. Accordingly, as will be discussed, movement of first area 201 relative to second area 202 in one direction can cause elastic stretching of second region 200 in some embodiments. Movement of first area 201 relative to second area 202 in an opposite direction can allow for resilient recovery of second region 200 in some embodiments. Since second region 200 is defined in collar 124 and throat 128 of upper 120 in the illustrated embodiments, movement of first area 201 relative to second area 202 can cause such stretching and recovery of collar 124 and/or throat 128.

Also, in some embodiments, first area 201 and second area 202 can have elasticity due to this location in upper 120. Thus, first area 201 can stretch and elongate when being moved toward second area 202 as shown by comparing FIGS. 3 and 4. Likewise, second area 202 can elongate and stretch toward first area 201 in some embodiments. First area 201 and second area 202 can resiliently recover to smaller dimensions once first area 201 and second area 202 are released from each other. Accordingly, first area 201 and second area 202 can be relatively small and compact when detached but can stretch toward each other to facilitate securement of first area 201 and second area 202.

Attachment device 204 can be of any suitable type for temporarily securing first area 201 and second area 202 together in a substantially fixed position. Attachment device 204 can also be configured to allow first area 201 and second area 202 to be secured together in two or more positions. Attachment device 204 can include one or more buttons, snaps, ties, hooks, latches, buckles, or other couplings.

Figure 5:
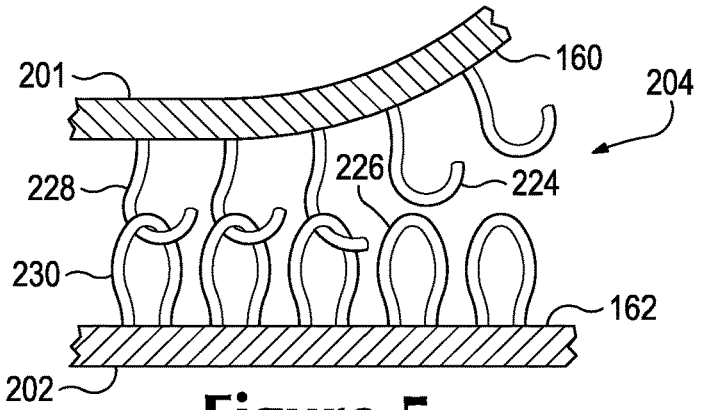
FIG. 5 is a schematic section view taken along the line 5-5 of FIG. 4.

For example, in some embodiments, attachment device 204 can include hook-and-loop type fastener. FIG. 5 illustrates an embodiment of this type of attachment device 204. As shown, attachment device 204 can include a plurality of hooks 224 that extend from inner surface 160 of first area 201. Attachment device 204 can also include a plurality of loops 226 that extend from outer surface 162 of second area 202. It will be appreciated that hooks 224 can extend from second area 202 and loops 226 can extend from first area 201 in other embodiments. Hooks 224 can be received by and can attach to loops 226 to secure first area 201 and second area 202 together. Attachment device 204 can resist detachment to keep first area 201 and second area 202 secured until wearer decides to detach first area 201 and second area 202. Then, wearer can pull first area 201 away from second area 202 to detach hooks 224 and loops 226. Attachment device 204 can also allow for repeated attachment and detachment of first area 201 and second area 202.

In some embodiments, hooks 226 and/or loops 224 can be part of a body that is independent of knitted component 134 and that is attached to knitted component 134 after knitted component 134 is formed. In other embodiments that will be discussed in detail below, hooks 226 and/or loops 224 can be defined by one or more strands 270 that form knitted component 134. For example, portions of strand 270 can be stitched within knit element 136 and portions of strand 270 can define loops 224 in some embodiments. Likewise, portions of strand 270 can be stitched within knitted element 136 and other portions of strand 270 can define hooks 226 in some embodiments.

Accordingly, as shown in FIGS. 3 and 8, selection element 132 can have an unsecured, or neutral position in some embodiments. In this position, first area 201 can be spaced from second area 202, and opening 206 can be substantially open. Also, in this position, collar 124 can have a first position. Collar 124 can be unstretched or can be partially stretched in this first position shown in FIGS. 3 and 8. Additionally, collar 124 can apply a relatively low amount of compression to the wearer. More specifically, collar 124 can have a first width 241 measured between opposite sides of rim 152 as shown in FIG. 8. Collar 124 can be relatively loose in this position in some embodiments. Alternatively, in some embodiments, collar 124 can apply some compression to the wearer in this unsecured position.

Figure 6:
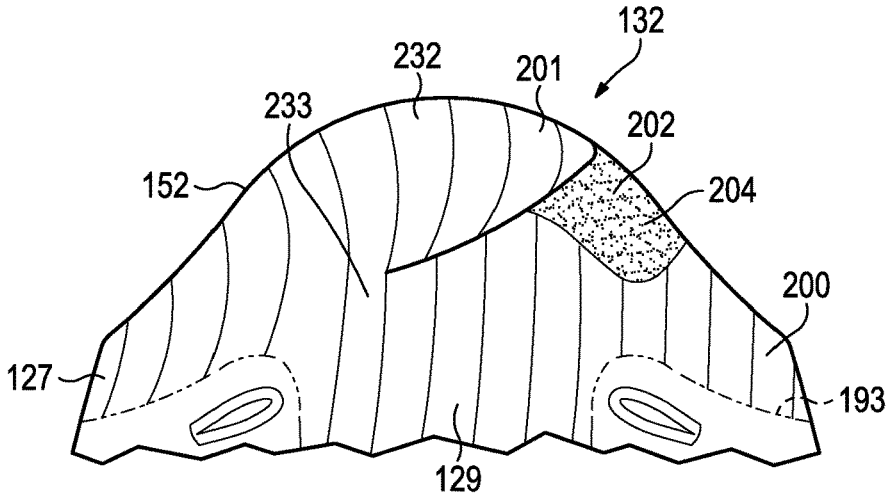
FIG. 6 is a front view of the selection element in a first secured position.

In contrast, as shown in FIGS. 6 and 9, selection element 132 can also have a first secured position in some embodiments. In this position, first area 201 can overlap second area 202. Overlap distance 263 is indicated in FIG. 9 as measured between first transition 216 and second transition 214. Inner surface 160 can face outer surface 162 in this position. Also, first area 201 can span across opening 206 in this position. For example, in some embodiments, first area 201 can substantially fill and cover over opening 206. Stated differently, first area 201 can close off opening 206 in this position. Additionally, attachment device 204 can secure first area 201 to second area 202 in the first position. Also, collar 124 can have a second width 243 as shown in FIG. 9. Second width 243 shown in FIG. 9 can be less than first width 241 as shown in FIG. 8. Also, collar portion 127 of the elastic second region 200 can be elastically stretched from the first position shown in FIGS. 3 and 8. This stretching is represented by the distortion of ribs 232 shown in FIGS. 3, 4, 5, and 6. As shown, ribs 232 are more curved and distorted in FIG. 6 as compared to FIG. 3, showing that collar portion 127 has been stretched due to movement of selection element 132 from unsecured position to secured position.

Thus, collar 124 can apply a moderate amount of compression to the wearer in this first secured position. Compression can be distributed relatively evenly across collar 124 in some embodiments. The amount of compression can be greater than the amount of compression applied in the unsecured position shown in FIG. 8. This compression force is represented in FIG. 9 with several arrows directed inwardly radially from rim 124. In some embodiments, throat portion 129 of second region 200 can also be stretched in this secured position such that throat 128 of upper 120 applies compression as well.

Figure 7:
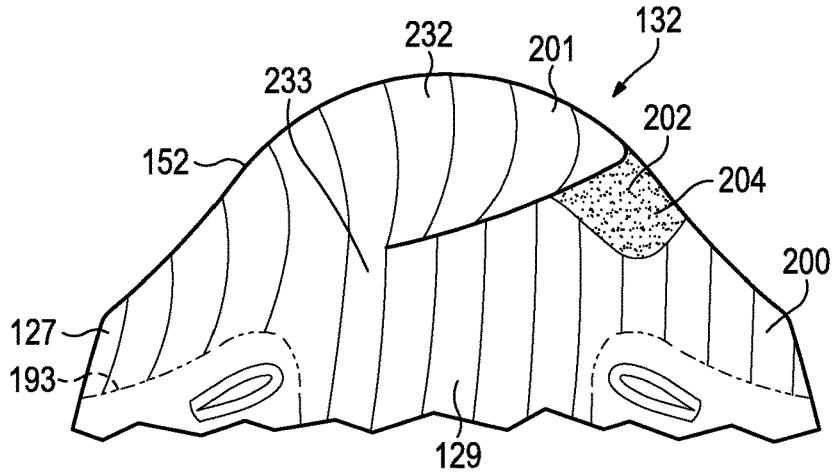
FIG. 7 is a front view of the selection element in a second secured position.

Furthermore, as shown in FIGS. 7 and 10, selection element 132 can further have a second secured position in some embodiments. In this position, first area 201 can overlap second area 202 similar to the first secured position shown in FIGS. 6 and 9. However, first area 201 can be advanced further over second area 202. Stated differently, first area 201 can overlap and cover more surface area of second area 202 in the second secured position as compared to the first secured position. Overlap distance 265 is indicated in FIG. 10 as measured between first transition 216 and second transition 214, and overlap distance 265 can be greater than overlap distance 263 shown in FIG. 9. Also, attachment device 204 can secure first area 201 to second area 202 in this position. Additionally, collar 124 can have a third width 245 as shown in FIG. 10. Third width 245 can be less than second width 243. Also, collar portion 127 and throat portion 129 of the elastic second region 200 can be further elastically stretched from the position shown by the distortion of ribs 232 shown in FIG. 7. Collar 124 can apply a high amount of compression to the wearer in this second secured position. The amount of compression in the second secured position can be greater than the amount of compression applied in the first secured position shown in FIG. 9. This compression force is represented in FIG. 10 with several arrows directed inwardly radially from rim 124.

It will be appreciated that although only two secured positions and one unsecured position are illustrated, there can by any number of positions of the selection element 132. Also, in some embodiments, first area 201 can cover over adjacent regions 233 disposed proximate to second area 202 while selection element 132 is in a secured position. Furthermore, adjustment device 204 can also increase the number of secured positions of selection element 132. More specifically, in embodiments in which adjustment device 204 includes hooks 224 and loops 226 of the type illustrated in FIG. 5, first area 201 can be adjusted and shifted into a large number of secured positions relative to second area 202. Accordingly, selection element 132 can allow for a high degree of adjustability for fitting footwear 100 to the wearer's foot and/or lower leg.

Moreover, it will be appreciated that selection element 132 can be relatively compact when in the unsecured position, the first secured position, and the second secured position. For example, when in the unsecured position, first area 201 and second area 202 can lie relatively flat against the wearer's ankle in some embodiments. Also, when in the secured position, first area 201 can lie relatively flat and relatively close to the wearer's body. Furthermore, in some embodiments, when selection element 132 is in the secured position, portions of rim 152 at first area 201 can lay closely adjacent portions of rim 152 at second area 202. Thus, selection element 132 is unlikely to become snagged against a foreign object. Also, selection element 132 is unlikely to inadvertently move from a secured position to the unsecured position. Moreover, selection element 132 can be more aesthetically pleasing due to its inconspicuousness.

Also, first area 201 can substantially cover over opening 206 when in the secured position. Additionally, opening 206 can be relatively small. For example, as shown in FIGS. 1 and 2, first area edge 218 and second area edge 222 can have curvature in some embodiments. The shape of this curvature can be convex or concave. The shapes of curvature of edge 218 and edge 222 can correspond to each other. For example, first area edge 218 can be convex, and second area edge 222 can be concave. In some embodiments, the radius of first area edge 218 can be substantially equal to the radius of second area edge 222. Accordingly, first area edge 218 can abut and substantially nest against second area edge 222 in some embodiments. FIGS. 1 and 2 illustrate this nesting relationship of first area edge 218 and second area edge 222 according to some embodiments. This can further increase compactness of selection element 132. Also, opening 206 can be relatively inconspicuous, and upper 120 can appear substantially continuous near selection element 132, especially when in the secured position(s).

Additionally, in the embodiments illustrated in FIGS. 3-10, first area 201 is pulled and partially wrapped about vertical axis 107 toward medial side 117 when moving from the unsecured position to the secured position. This can facilitate securement of selection element 132. For example, selection element 132 on the left shoe can be grasped and pulled by the hand of the wearer's right arm. In contrast, selection element 132 on the right shoe can be grasped and pulled by the hand of the wearer's left arm. This can improve the ergonomics of footwear 100 and selection element 132.

Manufacture of Selection Element and Upper

Upper 120 can be constructed in various ways. For example, upper 120 can include knitted component 134. Knitted component 134 can be knitted by hand or using a machine. For example, knitted component 134 can be manufactured according to co-owned U.S. patent application Ser. No. 13/781,514, filed Feb. 28, 2013, to Meir et al., the disclosure of which is incorporated by reference in its entirety.

Also, as mentioned above, at least one strand 270 of knitted component 134 can define either a hook 224 or a loop 226 of attachment member 204 of selection element 132. Stated differently, hook 224 and/or loop 226 can be formed of unitary knit construction with adjacent portions of knitted component 134. As shown in FIG. 5, hook 224 can be defined by a hook strand 228, which is formed of such unitary knit construction with adjacent portions of knitted component 134. Likewise, loop 226 can be defined by a loop strand 230, which is formed of such unitary knit construction with surrounding portions of knitted component 134.

In some embodiments, strand 270 can be incorporated in various ways to define loop strand 230. For example, strand 270 can be stitched to have a terry loop construction on first area 201 or second area 202 for providing a plurality of integrally attached loop strands 230. Strand 270 can also be knitted in other ways to define loop strands 230 without departing from the scope of the present disclosure. Also tensile strand 180 can be curved or otherwise routed to define loop strands 230 on first area 201 or second area 202 of selection element 132.

Also, strand 270 can be incorporated in various ways to define hook strand 228. For example, as shown in FIG. 18, portions of strand 270 can be stitched within knitted component 134 while other portions of strand 270 can be divided, split, fractured, severed, or otherwise broken to define broken loops 274. These broken loops 274 can define hook strands 228 represented in FIG. 5. These broken loops 274 can be included on inner surface 160 of first area 201 or on outer surface 162 of second area 202 of selection element 132. Additionally, in some embodiments, portions of tensile strand 180 can be inlaid or otherwise attached to knit element 136 while other portions of tensile strand 180 can extend and curve from knit element 136 to define hook 224.

Various methods can be used for fracturing or otherwise breaking strand 270 to form broken loops 274. For example, in some embodiments, knitted component 136 can be formed, and then, one or more strands 270 within knitted component 136 can be subsequently cut to form broken loops 274. This cutting can be performed manually, or using a cutting machine. In other embodiments, broken loops 274 can be formed while knitted component 136 is being knitted.

Figure 13:
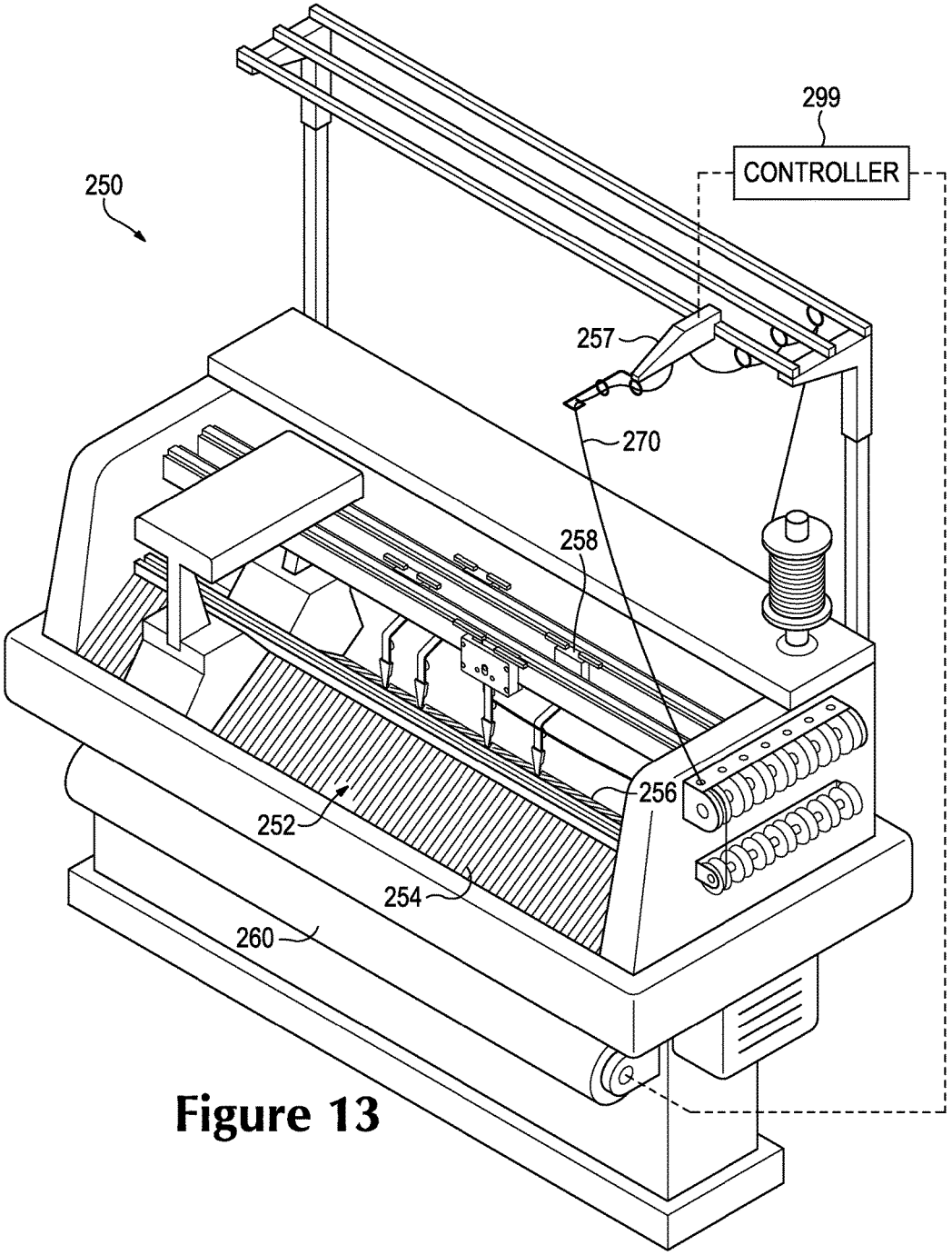
FIG. 13 is a perspective view of a flat knitting machine, which is suitable for manufacturing the knitted component of FIGS. 11 and 12.

More specifically, in some embodiments, knitted component 134 can be formed using a knitting machine 250, such as the knitting machine 250 shown in FIG. 13. Knitting machine 250 can be of any suitable type, such as a flat knitting machine. However, it will be appreciated that knitting machine 250 could be a circular knitting machine or another type without departing from the scope of the present disclosure.

As shown in the embodiment of FIG. 13, knitting machine 250 can include a needle bed 252 with a plurality of front needles 254 and a plurality of rear needles 256. Front needles 254 can be arranged in a common plane, and rear needles 256 can be arranged in a different common plane that intersects the plane of front needles 254. Knitting machine 250 can further include one or more feeders 258 that are configured to move over needle bed 252 and feed strands 262 toward needle bed 252. Knitting machine 250 can further include one or more tensioners 257 used to maintain a predetermined amount of tension within strand 262 during the knitting process. Moreover, knitting machine 250 can include one or more take-down devices 260 disposed beneath needle bed 252. Take-down device 260 can include one or more rollers, automated fingers, or other tools that are configured to grasp and pull knitted component 134 from needle bed 252. Take-down device 260 can include features that are disclosed in co-owned U.S. patent application Ser. No. 13/781,514, filed Feb. 28, 2013, to Meir et al., the disclosure of which is incorporated herein by reference in its entirety.

Figure 14:
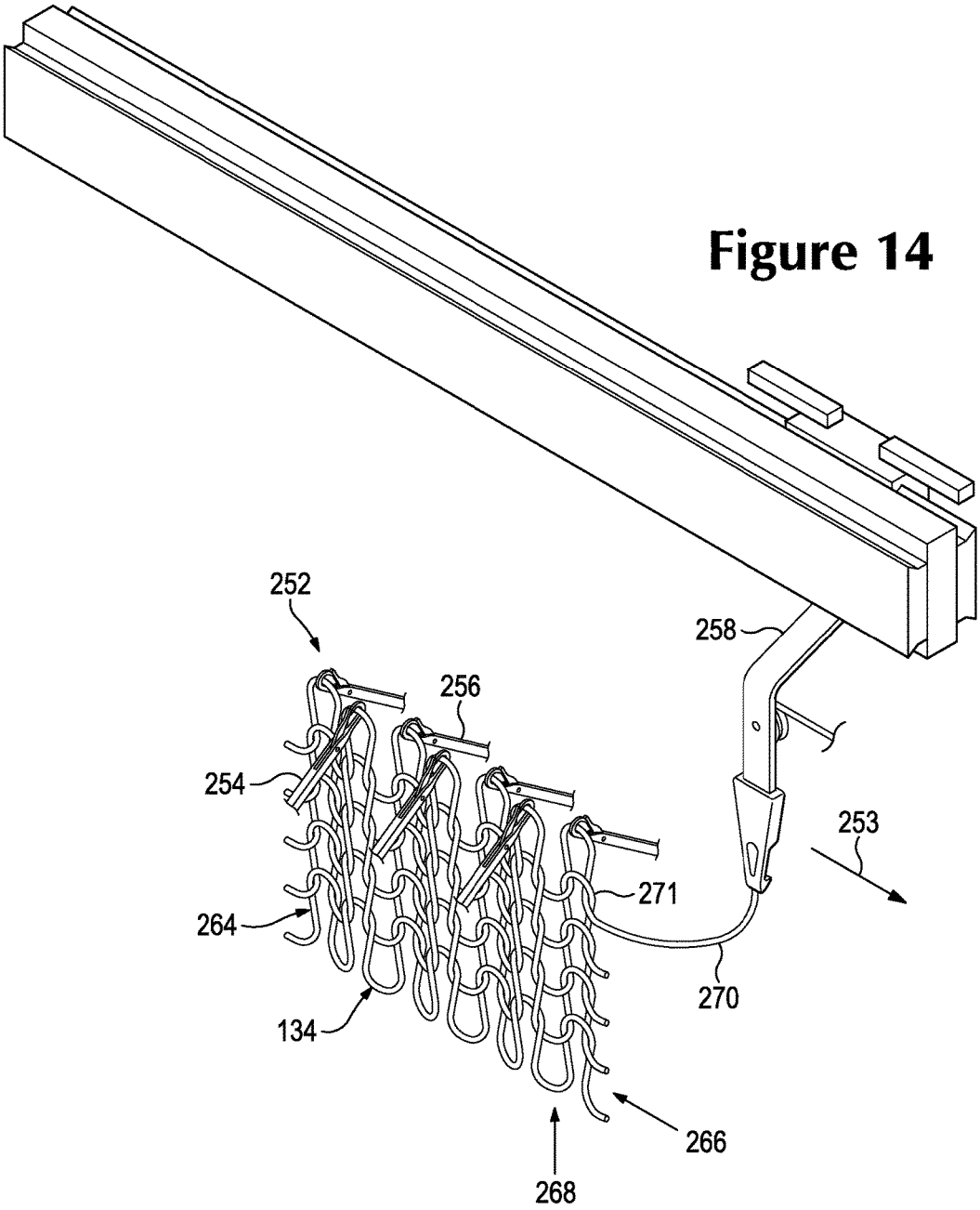
FIGS. 14 and 15 are schematic perspective views of the knitting machine of FIG. 12 showing formation of the knitted component of FIGS. 11 and 12.
Figure 15:
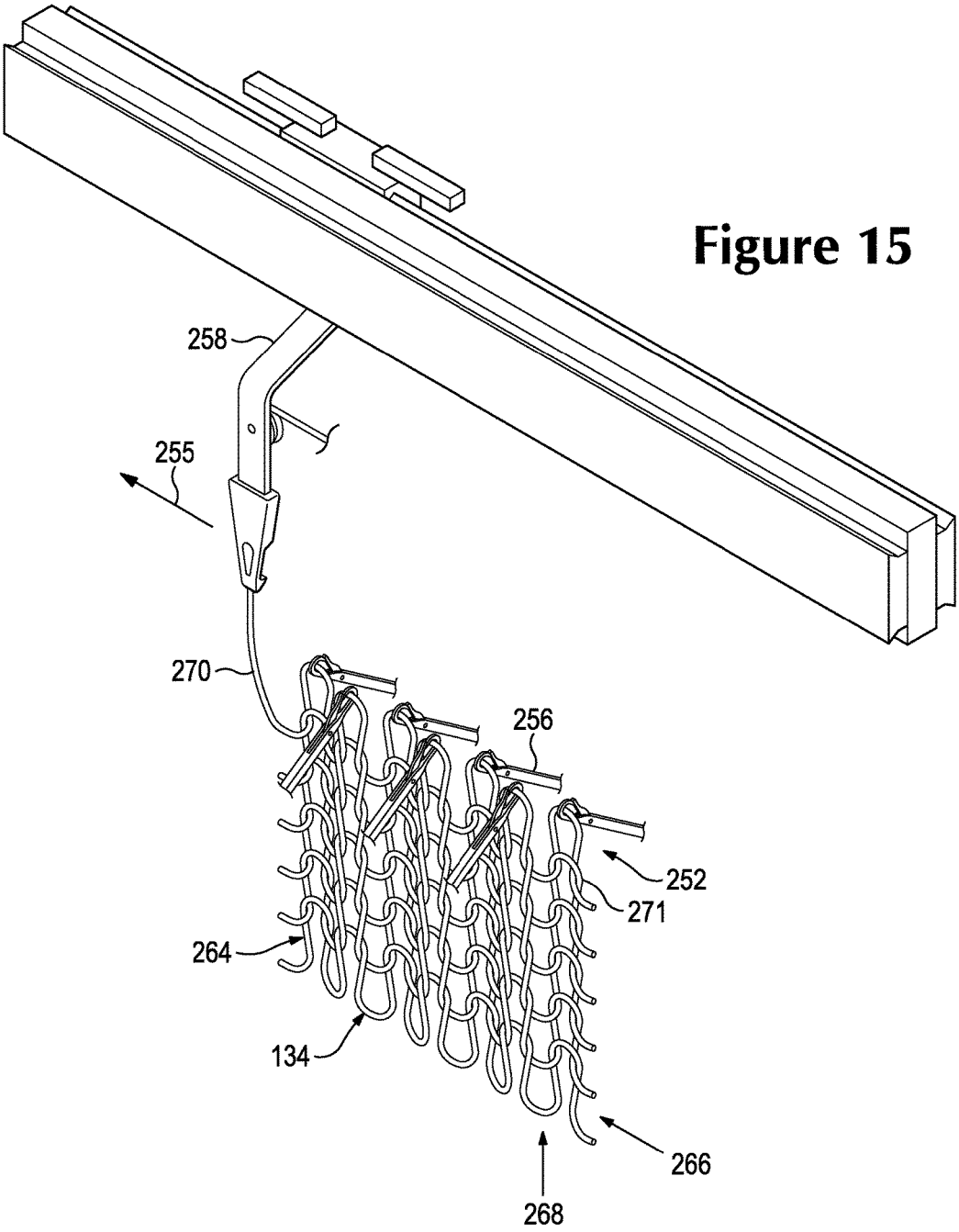

Embodiments of the knitting process are shown in FIGS. 14 and 15. For example, as feeder 258 moves across needle bed 252 in the direction of arrow 253 of FIG. 14, front needles 254 and rear needles 256 can actuate and manipulate strands 262 to form loops 271 of the type discussed above and shown in FIGS. 18 and 19. This can form a new course 266 for knitted component 134. Then, as feeder 258 moves in the opposite direction of arrow 255 of FIG. 15, needles 254 and needles 256 can form additional loops 271 as well as additional courses 266 and wales 268.

Knitted component 134 can continue to grow as additional courses 266 and wales 268 are added. Take-down device 260 can grasp portions of knitted component 134 during formation. For example, take-down device 260 can pull downward on knitted component 134 in a direction away from needle bed 252.

It will be appreciated that tensioners 257 and take-down device 260 can both apply tension to knitted component 134 during manufacture of knitted component 134. For example, tensioners 257 can be used to increase tension within strand 270 as strand 270 is being formed into knitted component 134. Also, take-down device 260 can pull on knitted component 134 while additional courses 266 and wales 268 are being added to knitted component 134. It will also be appreciated that additional components can be used to increase tension in knitted component 134.

As shown in FIG. 13, knitting machine 250 can include at least one controller 299. Controller 299 can be included on a computerized device, such as a personal computer, a hand-held tablet, or other device. Controller 299 can be in communication with tensioner 257 and/or take-down device 260. Controller 299 can also be configured to vary, change, and control the amount of tension applied by tensioner 257 and/or take-down device 260 to knitted component 134. In some embodiments, controller 299 can control both tensioner 257 and take-down device 260. In other embodiments, tensioner 257 and take-down device 260 can each include a separate respective controller 299.

Figure 16:
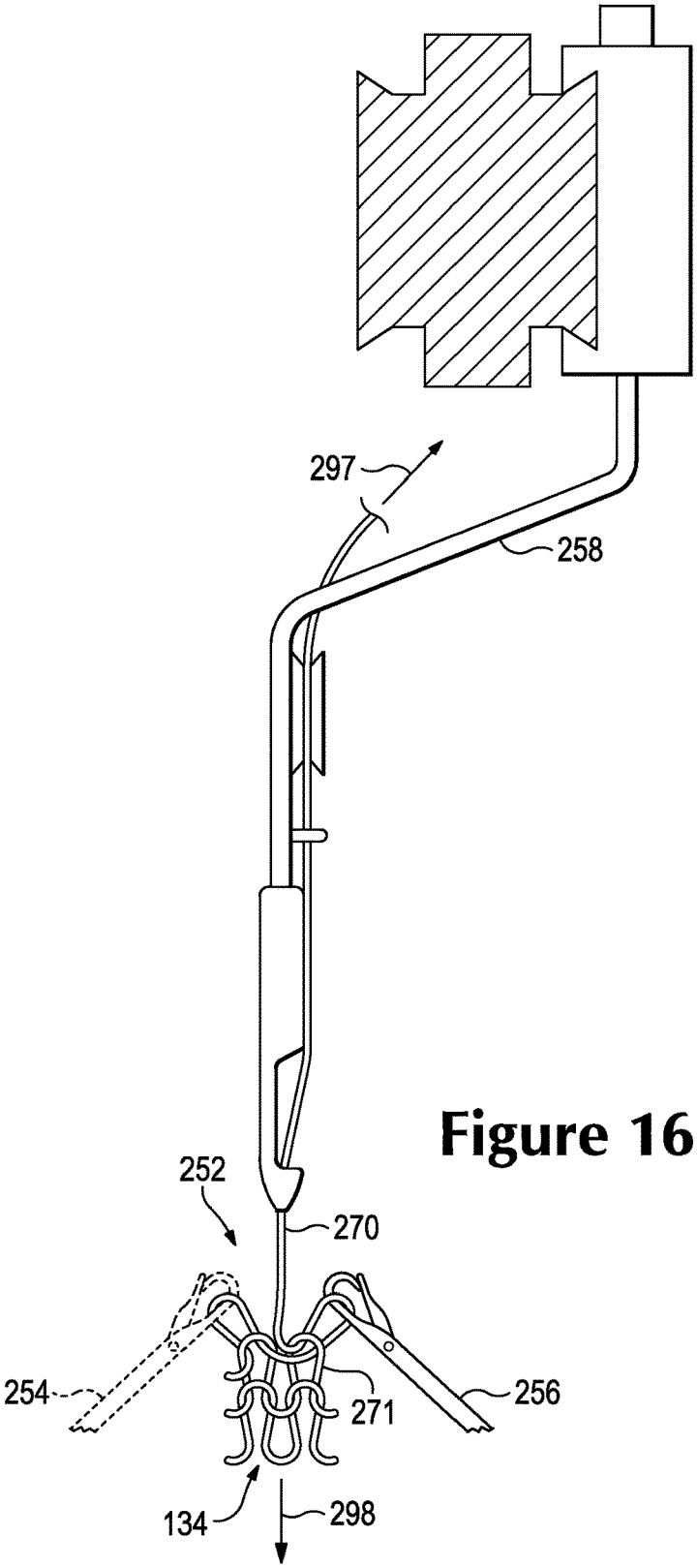
FIGS. 16 and 17 are schematic end views of the knitting machine showing a strand under tension and being broken.
Figure 17:
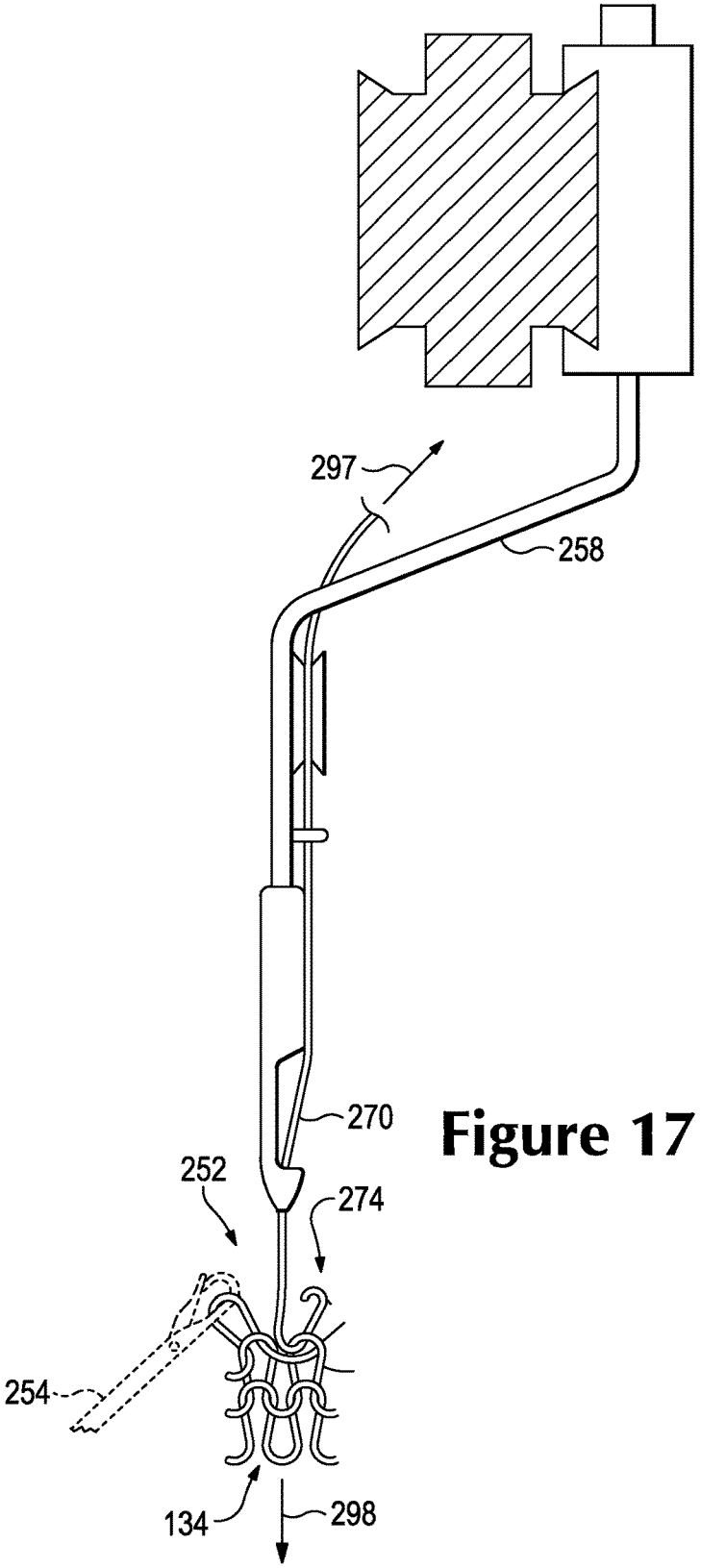

As shown in FIG. 16, as knitted component 134 is formed and strand 270 is held in a respective needle 256, tension can be applied to knitted component 134 and strand 270. For example, in some embodiments, tension can be applied from tensioner 257 as indicated in FIG. 16 by arrow 297. Tension can also be applied by take-down device 260 as indicated by arrow 298 in FIG. 16. Tension can be high enough to split, fracture, sever, divide, or otherwise break strand 270 away from needle 256 as shown in FIG. 17. Once broken, strand 270 can define broken loop 274 represented in FIG. 18.

In some embodiments, controller 299 can control tensioner 257 and/or take-down device 260 to increase tension when predetermined areas of knitted component 134 are being formed. For example, controller 299 can increase tension to create broken loops 274 at inner surface 160 of first area 201 as shown in FIG. 5. Once this area has been formed, controller 299 can decrease tension to prevent further breakage of other strands 270 within knitted component 134.

Moreover, in some embodiments, residual stress within strand 270 can cause strand 270 to curl once strand 270 has been broken as shown in FIG. 17. Thus, broken ends of strand 270 can take the form of a hook.

Also, the material of strand 270 can be specifically chosen to break in a controlled manner. The material of strand 270 can also be chosen to have sufficient rigidity such that broken loop 274 can function as hook 224. For example, in some embodiments, strand 270 can be a monofilament. Strand 270 can also be made from a polymeric material in some embodiments.

In additional embodiments, once broken loop 274 is formed, broken loop 274 can be further processed to add rigidity. For example, broken loop 274 can be reinforced using a fusible yarn of the type mentioned above and disclosed in U.S. Pat. No. 6,910,288, which issued on Jun. 28, 2005 to Dua, and which is incorporated by reference in its entirety. For example, as shown in FIG. 19, first strand 272 can be made from such fusible yarns, and second strand 273 can be made from another material. By applying heat, first strand 272 can fuse to second strand 273. As a result, broken loop 274 can have added rigidity, and broken loop 274 can function more effectively as hook 224.

Moreover, in some embodiments represented in FIG. 19, first strand 272 and second strand 273 can extend generally in the same direction along a plurality of common courses, including a common course 266, to form knitted component 134. In some embodiments, only one strand of first strand 272 and second strand 273 may be broken along common course 266. In one embodiment, first strand 272 can be broken to form broken loop 274. In contrast, second strand 273 can remain unbroken within common course 266 and thereby remain secured to adjacent courses within knitted component 134. With this arrangement, broken loop 274 can define hook 224 of the type shown in FIG. 5 while second strand 273 can secure knitted component 134 together and prevent unravelling of knitted component 134.

Figure 20:
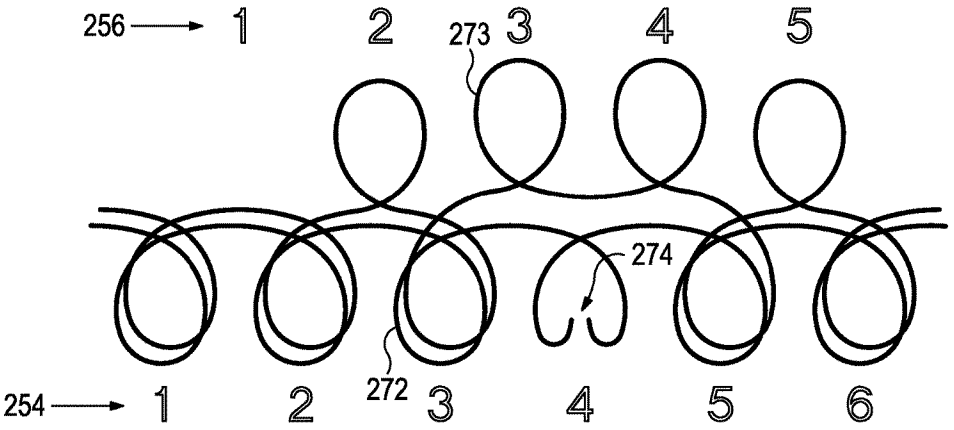
FIG. 20 is a stitching diagram of a portion of the knitted component according to additional embodiments of the present disclosure.

FIG. 20 shows an additional embodiment of a knitting diagram for knitting first strand 272 and second strand 273 together to include a broken loop. In some embodiments, first strand 272 can be knitted using front needles 254 of knitting machine 250. More specifically, loops are formed with first strand 272 at front needle positions 1, 2, 3, 4, 5, and 6 in the embodiment illustrated, for example, using a front jersey knitting pattern. Also, broken loop 274 can be formed using first strand 272, similar to the embodiments discussed above. For example, as illustrated in the embodiment of FIG. 20, broken loop 274 can be formed at front needle position 4. In contrast, second strand 273 can be partially knitted with front needles 254 and partially knitted with rear needles 256. For example, loops can be formed with second strand 273 at front needle positions 1, 2, 3, 5, and 6 and at rear needle positions 2, 3, 4, and 5 in the embodiment shown. Thus, even though first strand 272 is broken at broken loop 274, second strand 273 can be secured to adjacent areas of the knitted component and can, thus, prevent unravelling of the knitted component.

Figure 22:
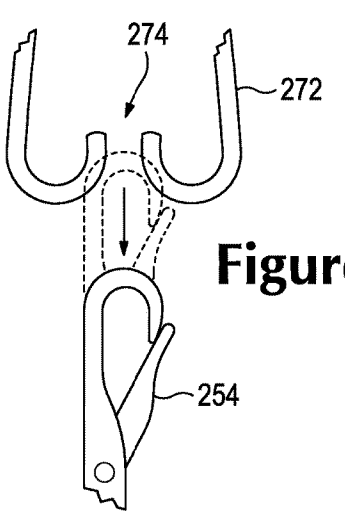
FIG. 22 is a schematic view of the strand of FIG. 21 shown being broken from the needle to form the hook of the selection element.
Figure 21:
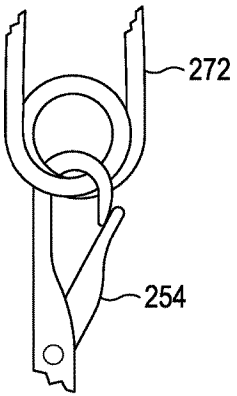
FIG. 21 is a schematic view of a strand that is encircled about an end of a needle before the strand is broken to form a hook for the selection element.

FIGS. 21 and 22 illustrate the breaking of strand 272 in greater detail according to additional embodiments. In some embodiments, a greater amount of strand 272 can be provided to form a broken loop with larger broken ends. For example, as shown in FIG. 21, strand 272 can continuously encircle needle 254 at least once before strand 272 is broken. Then, as shown in FIG. 22, needle 254 can be pulled away relative to strand 272 to break strand 272 and to form broken strand 274. It will be appreciated that the increase in the amount of strand 272 encircling needle 254 before being broken to form broken strand 274 can result in an increase in the size and amount of curvature of a broken end of broken strand 274. Accordingly, the hook formed by the broken end can be larger and/or have an increased surface area within the curved portion of the hook.

FIGS. 23 through 27 illustrate a method of encircling and breaking strand 272 according to some embodiments. In the illustrated embodiment, only strand 272 is shown for purposes of clarity; however, it will be appreciated that this method can be employed for knitted components having more than one strand, such as the embodiments of FIGS. 19 and 20. Also, a number of front needles 254 and rear needles 256 are shown while others have been removed for clarity.

Figure 23:
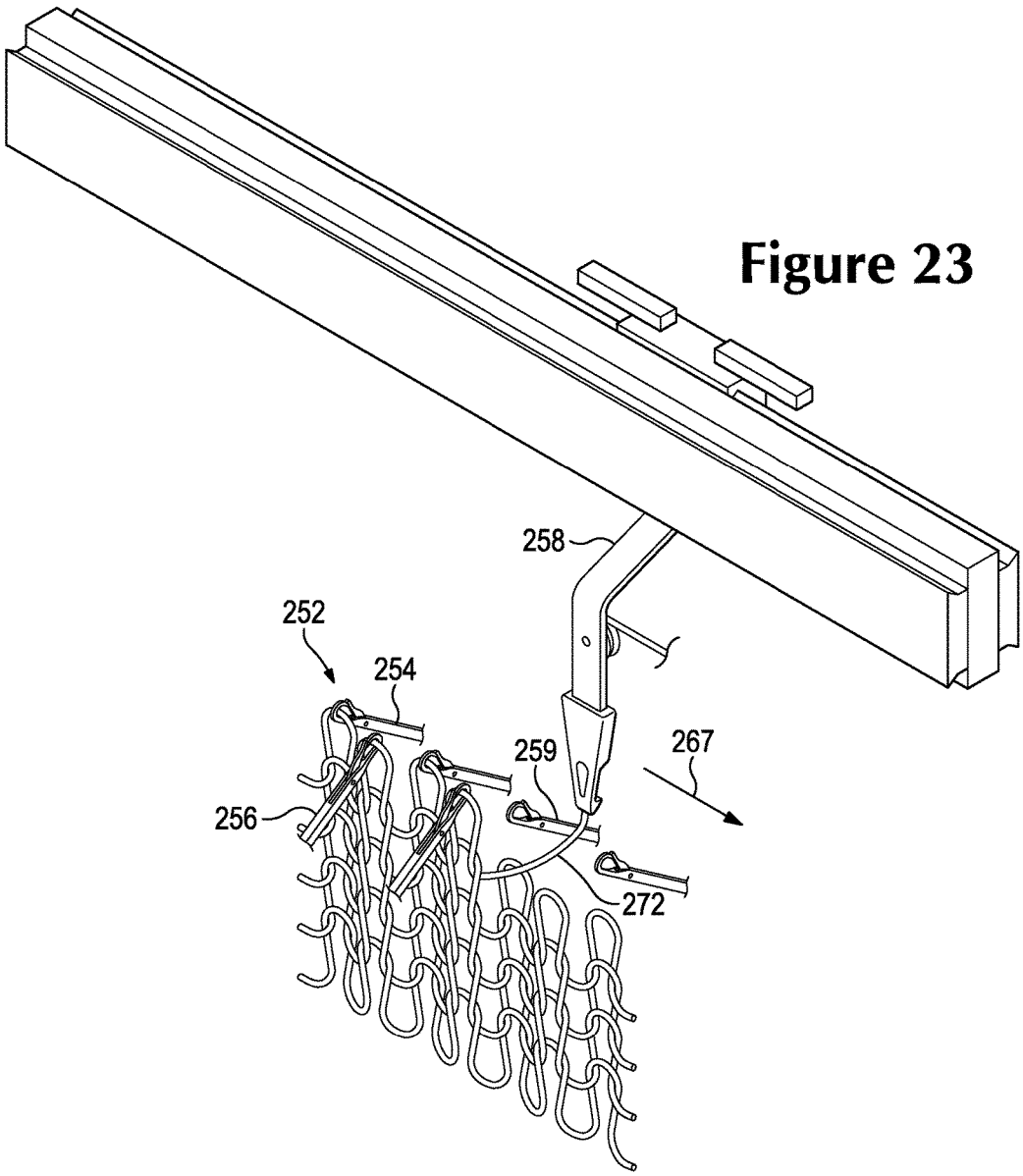
FIGS. 23-27 are perspective views of a portion of a knitting machine shown during formation of the hook of the selection element according to additional embodiments.

As shown in FIG. 23, front needles 254 can include a predetermined needle 259, which can be used for breaking strand 272 to form broken loop 274 as will be discussed. It will be appreciated that front needles 254 and rear needles 256 can each move between a retracted position and an extended position. For example, needle 259 is shown in the retracted position in FIG. 23 and is shown in the extended position in FIG. 24. Normally, feeder 258 can move across needle bed 252, and needles 254 and needles 256 can move between the retracted position and the extended position to receive strand 272, to form loops, and to secure loops to adjacent courses to form a knitted component.

Figure 24:
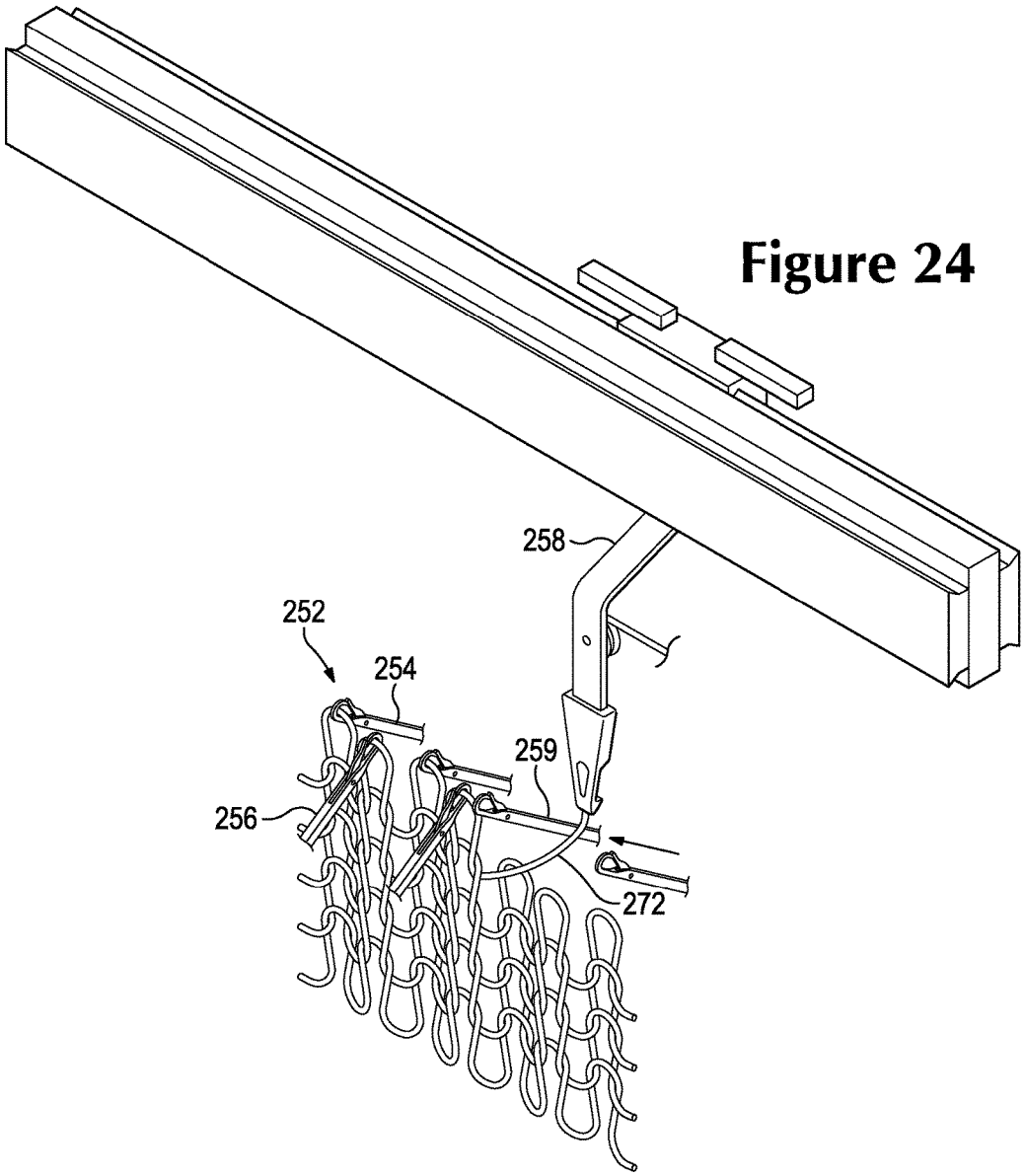
Figure 25:
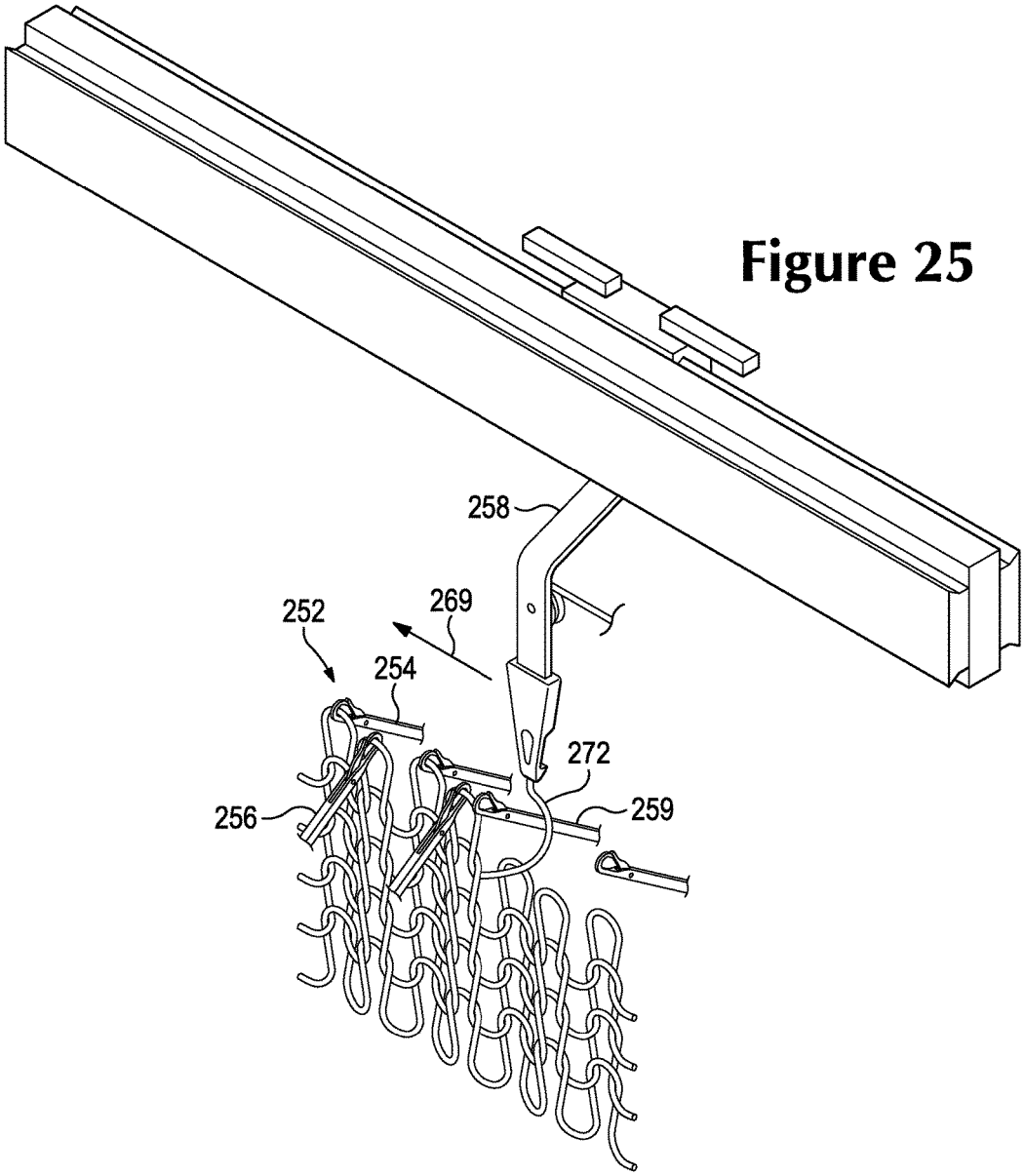
Figure 26:
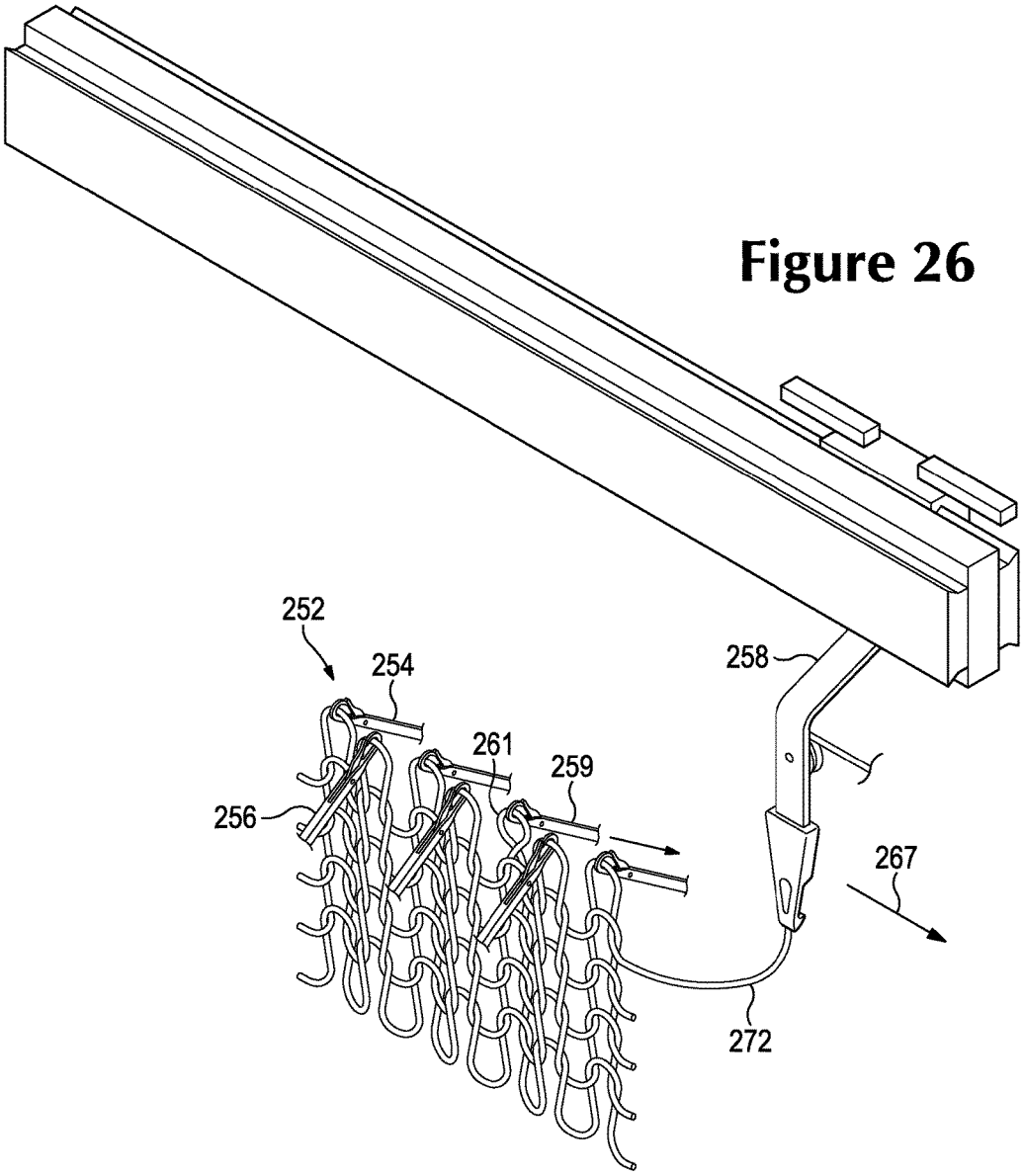
Figure 27:
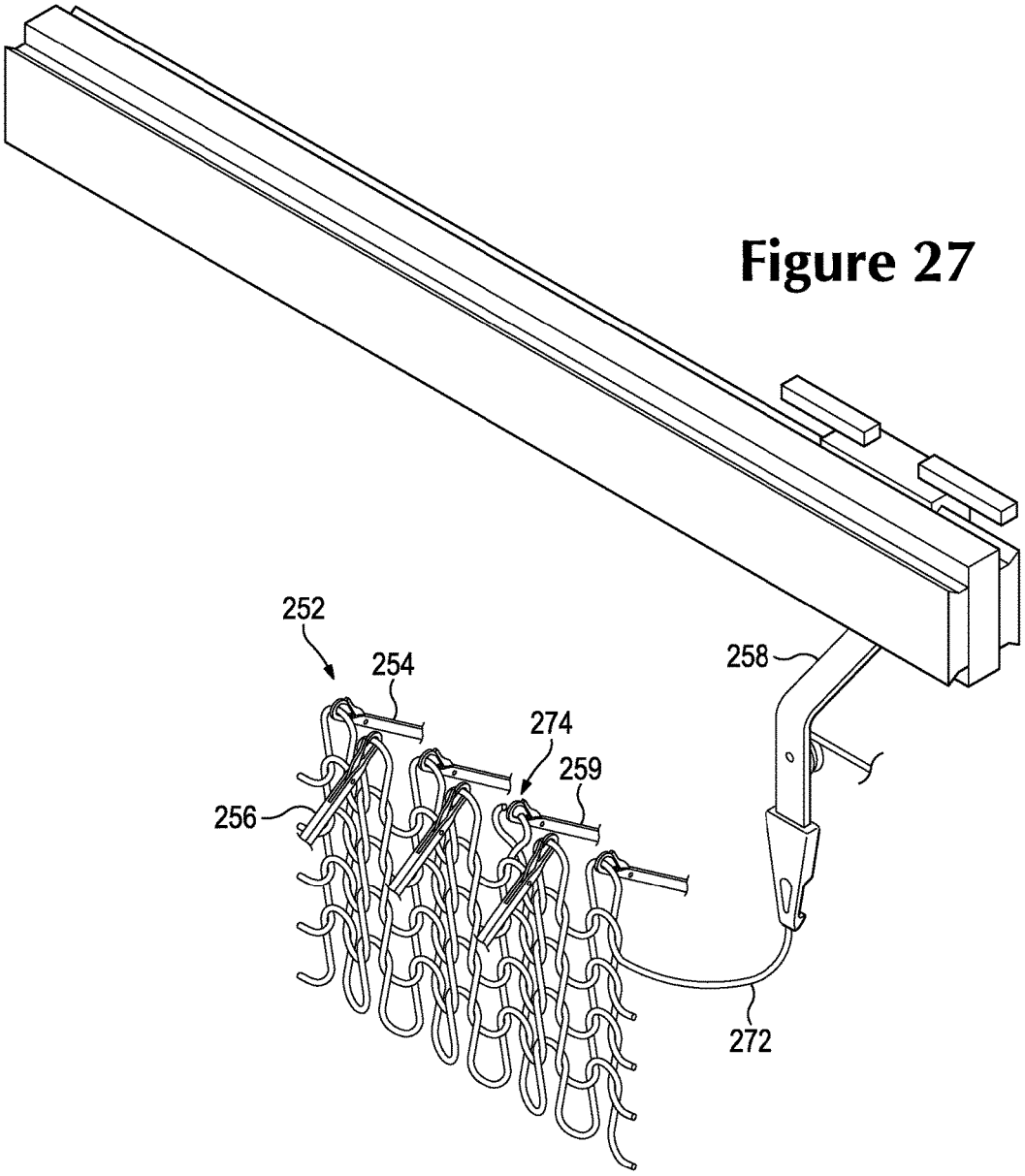

However, in some embodiments represented in FIG. 23, feeder 258 can move in a first direction 267 and bypass needle 259 while needle 259 remains in the retracted position. Subsequently, as shown in FIG. 24, needle 259 can move to the extended position such that strand 272 is disposed underneath needle 259. Then, as shown in FIG. 25, feeder 258 can reverse directions (i.e., move in a second direction 269) while needle 259 remains in the extended position. As a result, strand 272 can lie over needle 259. Next, as shown in FIG. 26, feeder 258 can move back in the first direction 267, and needle 259 can then move back toward its retracted position causing strand 272 to be encircled around needle 259. Then, as shown in FIG. 27, strand 272 can be broken from needle 259 to form broken strand 274. In some cases, strand 272 can be broken due to movement of needle 259 toward the retracted position exerting sufficient force to cause tensile failure of strand 272. In other cases, strand 272 can be broken due to tension in strand 272 applied from tensioner 257 and/or take down device 260 shown in FIG. 13 causing tensile failure of strand 272. In still other cases, a combination of the movement of needle 259 toward the retracted position and applied tension from tensioner 257 and/or take down device 260 may be used to cause tensile failure of strand 272 to form broken strand 274.

Accordingly, using this process, hooks associated with one or more broken strands can be selectively provided at different portions of a knitted component. With this arrangement, the knitted component can include hooks disposed within the structure of the knitted component itself. Other elements, including portions of selection element 132, can be provided with corresponding components that are configured to engage with the hooks within the knitted component to attach and releasably secure the elements to the knitted component.

As described with reference to the various embodiments herein, selection element 132 can allow the wearer to quickly and effectively vary the tightness and looseness of footwear 100. Accordingly, selection element 132 may be configured to facilitate putting on footwear 100 and removal of footwear 100 from the wearer's foot and/or to increase or decrease support or stability of footwear 100. Selection element 132 can be located in a convenient area on footwear 100. Also, selection element 132 can be relatively inconspicuous. Moreover, selection element 132 can be manufactured in an efficient manner.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of footwear comprising: a sole structure; and an upper that is attached to the sole structure, the upper defining a void that is configured to receive a foot of a wearer, the upper including a one-piece knitted component formed of unitary knit construction, wherein the upper comprises a collar with a rim, the one-piece knitted component including a compression member adjacent the collar, wherein the compression member is configured to apply an amount of compression to the wearer to secure the article of footwear to the wearer's foot, the compression member including a selection element, the selection element including a first area and a second area, the first area configured to move relative to the second area between an unsecured position and a secured position to change the amount of compression applied by the compression member, the first area spaced away from the second area in the unsecured position, the first area attached to the second area in the secured position; the selection element further including an attachment member formed from a plurality of strands of the one-piece knitted component, wherein at least one of the plurality of strands defines a hook on one of the first and second areas and another of the plurality of strands defines a loop on the other of the first and second areas; and wherein the hook and loop are configured to secure the first area and the second area in the secured position.

2. The article of footwear of claim 1, wherein the first area is configured to move relative to the second area between a first secured position and a second secured position, the first area being attached to the second area in both the first secured position and the second secured position, wherein the selection element is configured to apply a first amount of compression to the wearer in the first secured position, the selection element is further configured to apply a second amount of compression to the wearer in the second secured position, and the second amount of compression is greater than the first amount of compression.

3. The article of footwear of claim 1, wherein the compression member is elastic and the compression member is configured to stretch between an unsecured position and a secured position, wherein the amount of compression applied by the compression member changes between the unsecured position and the secured position, and wherein the selection element is configured to stretch the compression member between the unsecured position and the secured position as the first area moves relative to the second area.

4. The article of footwear of claim 1, wherein the rim defines a collar opening, and wherein the first area and the second area of the selection element are defined proximate the rim.

5. The article of footwear of claim 4, wherein the upper includes a throat portion and a forefoot portion, the throat portion extending from the rim toward the forefoot portion, and wherein the first area and the second area of the selection element are defined proximate the throat portion.

6. The article of footwear of claim 1, wherein the opening separates the first area and the second area.

7. The article of footwear of claim 6, wherein the first area is defined by the rim and by a first area edge and wherein the second area is defined by the rim and by a second area edge, wherein the opening is defined between the first area edge and the second area edge, and wherein the first area edge and the second area edge have substantially corresponding curvature.

8. The article of footwear of claim 1, wherein the first area overlaps the second area in the secured position.

9. The article of footwear of claim 1, wherein the at least one of the plurality of strands is formed of unitary knit construction with an adjacent portion of the knitted component.

10. An article of footwear comprising: a sole structure; and an upper that includes a one-piece knitted component formed of unitary knit construction, wherein the one-piece knitted component includes a collar, the collar having a rim at an uppermost edge of the collar that at least partially defines a collar opening, the one-piece knitted component further including a selection element with a first area and a second area, the first area configured to move relative to the second area between an unsecured position and a secured position, the first area spaced away from the second area in the unsecured position, the first area attached to the second area in the secured position, wherein the selection element further includes an attachment member formed from a plurality of strands of the one-piece knitted component, wherein at least one of the plurality of strands defines a hook on one of the first and second area and another of the plurality of strands defines a loop on the other of the first and second area; and wherein the hook and loop are configured to secure the first area and the second area in the secured position, and wherein the selection element is configured to stretch the collar when the selection element moves from the unsecured position to the secured position, and the collar is configured to compress against a wearer when the selection element is in the secured position.

11. The article of footwear of claim 10, wherein the selection element further includes an aperture that separates the first area and the second area, and wherein the first area is configured to span across the aperture and stretch the collar when moving from the unsecured position to the secured position.

12. The article of footwear of claim 11, wherein the first area is configured to cover over and close off the aperture when in the secured position.

13. The article of footwear of claim 11, wherein the first area overlaps the second area when in the secured position.

14. The article of footwear of claim 11, wherein the aperture extends from the rim and is open to the collar opening.

15. The article of footwear of claim 10, wherein the at least one of the plurality of strands is formed of unitary knit construction with an adjacent portion of the one-piece knitted component.

* * * * *